US011244777B2

(12) United States Patent
Masuda et al.

(10) Patent No.: US 11,244,777 B2
(45) Date of Patent: Feb. 8, 2022

(54) R-T-B PERMANENT MAGNET

(71) Applicant: TDK Corporation, Tokyo (JP)

(72) Inventors: Takeshi Masuda, Tokyo (JP); Taeko Tsubokura, Tokyo (JP); Taku Murase, Tokyo (JP)

(73) Assignee: TDK Corporation, Tokyo (JP)

( * ) Notice: Subject to any disclaimer, the term of this patent is extended or adjusted under 35 U.S.C. 154(b) by 78 days.

(21) Appl. No.: 16/698,019

(22) Filed: Nov. 27, 2019

(65) Prior Publication Data

US 2020/0176155 A1 Jun. 4, 2020

(30) Foreign Application Priority Data

Dec. 3, 2018 (JP) ..... JP2018-226665

(51) Int. Cl.
*H01F 1/057* (2006.01)
*C22C 38/16* (2006.01)
(Continued)

(52) U.S. Cl.
CPC ..... *H01F 1/057* (2013.01); *C22C 38/002* (2013.01); *C22C 38/005* (2013.01); *C22C 38/06* (2013.01);
(Continued)

(58) Field of Classification Search
CPC ..... H01F 1/057; C22C 38/002; C22C 38/005; C22C 38/06; C22C 38/10; C22C 38/14; C22C 38/16
(Continued)

(56) References Cited

U.S. PATENT DOCUMENTS

2020/0161047 A1 5/2020 Zhou et al.
2020/0411236 A1 12/2020 Kuniyoshi

FOREIGN PATENT DOCUMENTS

CN 104252939 B * 10/2016
CN 107146670 A 9/2017
(Continued)

OTHER PUBLICATIONS

Yongli, et al., CN 104252939 B machine translation, Oct. 5, 2016, entire translation (Year: 2016).*

*Primary Examiner* — Humera N. Sheikh
*Assistant Examiner* — Katherine A Christy
(74) *Attorney, Agent, or Firm* — Faegre Drinker Biddle & Reath LLP

(57) ABSTRACT

An R-T-B permanent magnet comprises rare-earth elements R, transition metal elements T, and boron B; wherein at least some of the rare-earth elements R is Nd and at least one of Tb and Dy; at least some of the transition metal elements T are Fe; the R-T-B permanent magnet comprises a plurality of main phase grains and grain boundary triple points each surrounded by the main phase grains; the grain boundary triple points comprise at least one of Nd and Pr, at least one of Tb and Dy, at least one of Fe and Co, and copper; the average contents of Nd, Pr, Tb, Dy, Fe, Co and Cu each (unit: atom %) are represented by [Nd], [Pr], [Tb], [Dy], [Fe], [Co] and [Cu]; ([Fe]+[Co])/([Nd]+[Pr]) is 2 or more and 5 or less; and [Cu]/([Tb]+[Dy]) is 1 or more and 4 or less.

3 Claims, 8 Drawing Sheets

(51) Int. Cl.

| | |
|---|---|
| ***C22C 38/14*** | (2006.01) |
| ***C22C 38/00*** | (2006.01) |
| ***C22C 38/10*** | (2006.01) |
| ***C22C 38/06*** | (2006.01) |

(52) U.S. Cl.
CPC ..... *C22C 38/10* (2013.01); *C22C 38/14* (2013.01); *C22C 38/16* (2013.01); *C22C 2202/02* (2013.01)

(58) Field of Classification Search
USPC ..... 420/83
See application file for complete search history.

(56) References Cited

FOREIGN PATENT DOCUMENTS

| | | | |
|---|---|---|---|
| CN | 109964290 | A | 7/2019 |
| JP | 2011-187734 | A | 9/2011 |
| WO | WO 2018/143229 | A1 | 12/2015 |

* cited by examiner

R-T-B PERMANENT MAGNET

TECHNICAL FIELD

The present invention relates to an R-T-B permanent magnet.

BACKGROUND

An R-T-B permanent magnet containing rare-earth elements R (neodymium or the like), transition metal elements T (iron or the like) and boron B has excellent magnetic properties. As indices of magnetic properties of an R-T-B permanent magnet, residual magnetic flux density Br (residual magnetization) and coercivity HcJ are generally used.

An R-T-B permanent magnet is a nucleation type permanent magnet. Application of a magnetic field in the direction opposite to magnetization direction to a nucleation type permanent magnet allows magnetization reversal nuclei to easily occur in the vicinity of grain boundaries of many crystal grains (main phase grains) of the permanent magnet. The coercivity of a permanent magnet is reduced by the magnetization reversal nuclei.

In order to improve the coercivity of an R-T-B permanent magnet, heavy rare-earth elements such as dysprosium is added to the R-T-B permanent magnet (refer to Japanese Unexamined Patent Publication No. 2011-187734). Addition of heavy rare-earth elements allows an anisotropic magnetic field to easily grow larger locally in the vicinity of grain boundaries, so that magnetization reversal nuclei hardly occur in the vicinity of grain boundaries, resulting in increase of coercivity. In the case where the amount of heavy rare-earth elements added is too much, however, the saturation magnetization (saturation magnetic flux density) of the R-T-B permanent magnet decreases, and the residual magnetic flux density also decreases. It is therefore desirable to balance between the residual magnetic flux density and the coercivity of a heavy rare-earth element-containing R-T-B permanent magnet. Since the cost of heavy rare-earth elements is high, it is also desirable that the content of the heavy rare-earth elements in an R-T-B permanent magnet is reduced in order to reduce the production cost of the R-T-B permanent magnet.

SUMMARY

The present invention has been completed in light of the above-mentioned circumstances, and an object thereof is to provide an R-T-B permanent magnet excellent in magnetic properties.

An R-T-B permanent magnet in an aspect of the present invention comprises rare-earth elements R, transition metal elements T, and boron B; wherein at least some of the rare-earth elements R are neodymium and at least one of terbium and dysprosium; at least some of the transition metal elements T are iron; the R-T-B permanent magnet comprises a plurality of main phase grains and grain boundary triple points each surrounded by three or more main phase grains; the grain boundary triple points comprise at least one of neodymium and praseodymium, at least one of terbium and dysprosium, at least one of iron and cobalt, and copper; the average content of neodymium in grain boundary triple points is represented by [Nd] atom %; the average content of praseodymium in grain boundary triple points is represented by [Pr] atom %; the average content of terbium in grain boundary triple points is represented by [Tb] atom %; the average content of dysprosium in grain boundary triple points is represented by [Dy] atom %; the average content of iron in grain boundary triple points is represented by [Fe] atom %; the average content of cobalt in grain boundary triple points is represented by [Co] atom %; the average content of copper in grain boundary triple points is represented by [Cu] atom %; [Nd], [Pr], [Fe] and [Co] satisfy $2.00 \leq ([Fe]+[Co])/([Nd]+[Pr]) \leq 5.00$; and [Tb], [Dy] and [Cu] satisfy $1.00 \leq [Cu]/([Tb]+[Dy]) \leq 4.00$.

The total content of terbium and dysprosium in the whole of the R-T-B permanent magnet may be 0.20% by mass or more and 5.00% by mass or less.

The total content of neodymium, praseodymium, terbium and dysprosium in the whole of the R-T-B permanent magnet may be 27.00% by mass or more and 33.00% by mass or less; the copper content in the whole of the R-T-B permanent magnet may be 0.04% by mass or more and 0.50% by mass or less; the gallium content in the whole of the R-T-B permanent magnet may be 0.03% by mass or more and 0.30% by mass or less; the cobalt content in the whole of the R-T-B permanent magnet may be 0.30% by mass or more and 3.00% by mass or less; the aluminum content in the whole of the R-T-B permanent magnet may be 0.15% by mass or more and 0.30% by mass or less; the zirconium content in the whole of the R-T-B permanent magnet may be 0.10% by mass or more and 1.00% by mass or less; the manganese content in the whole of the R-T-B permanent magnet may be 0.02% by mass or more and 0.10% by mass or less; and the boron content in the whole of the R-T-B permanent magnet may be 0.85% by mass or more and 1.05% by mass or less.

According to the present invention, an R-T-B permanent magnet excellent in magnet properties is provided.

DETAILED DESCRIPTION

Figure 1A:
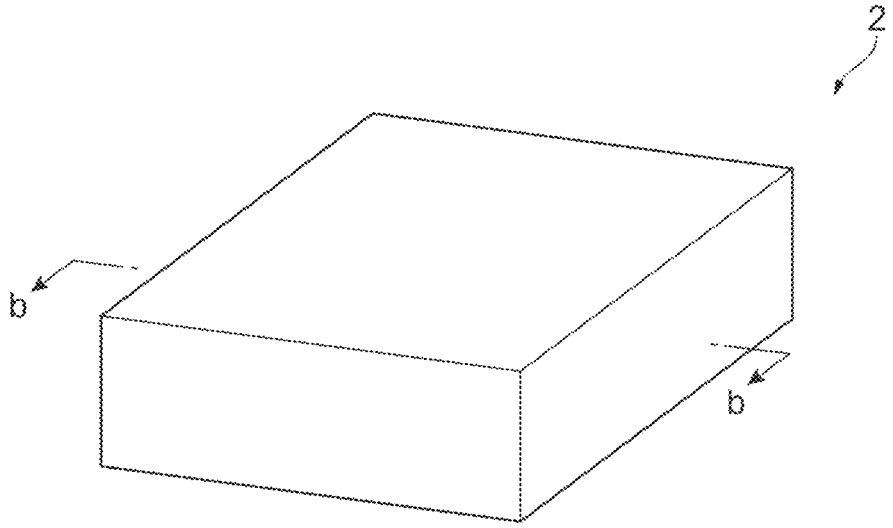
FIG. 1A is a schematic perspective view of an R-T-B permanent magnet in an embodiment of the present invention.

Suitable embodiments of the present invention will be described hereinafter with reference to drawings. In the drawings, the same symbols are given to the same or corresponding elements. The present invention is not limited to the following embodiments. A "permanent magnet" described in the following means an R-T-B permanent magnet.

(Permanent Magnet)

Figure 1B:
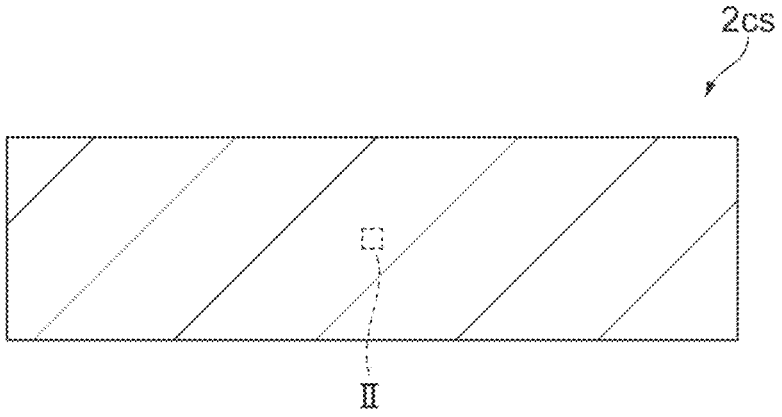
FIG. 1B is a schematic cross-sectional view of an R-T-B permanent magnet shown in FIG. 1A (viewed from the arrow direction of b-b line).
Figure 2:
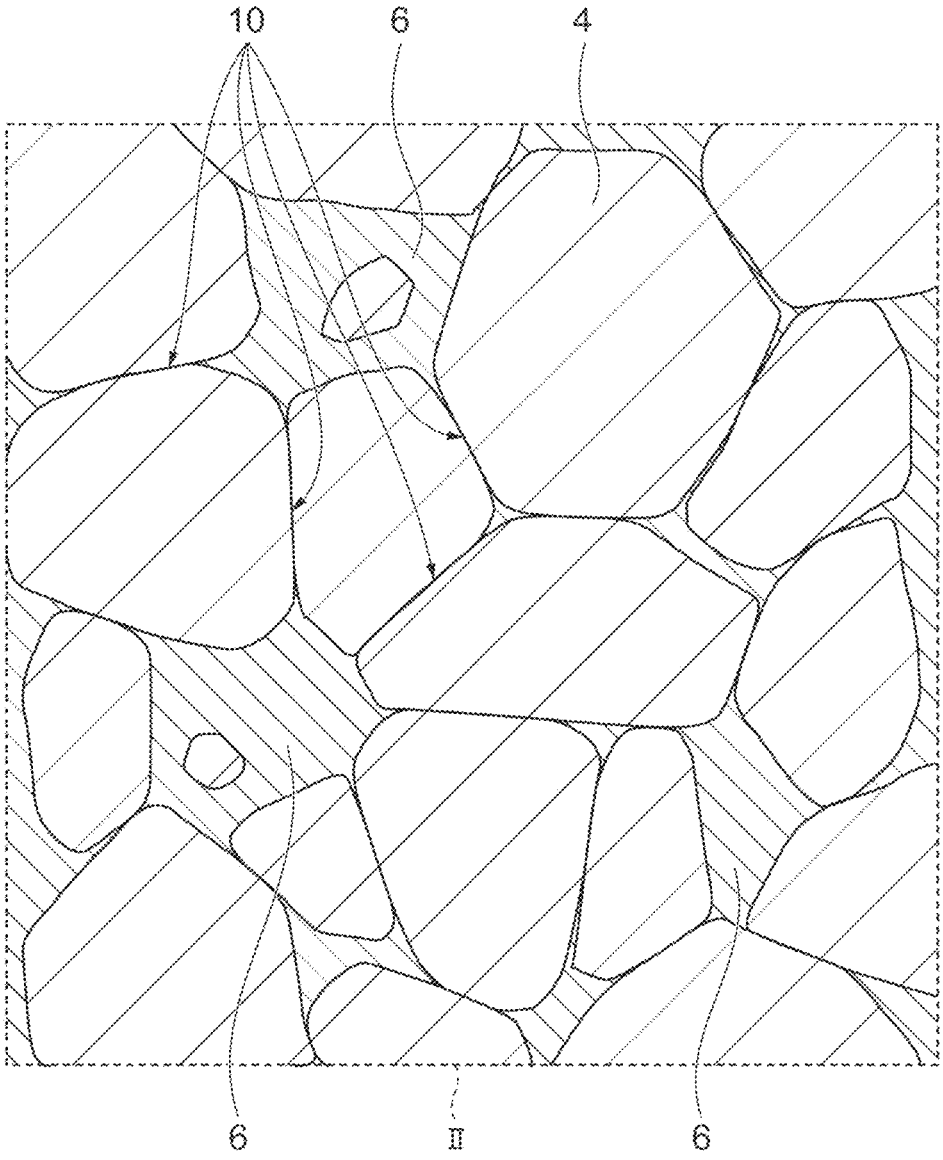
FIG. 2 is an enlarged view of a portion (region II) of the cross-section of an R-T-B permanent magnet shown in FIG. 1B.

FIG. 1A is a schematic perspective view of a permanent magnet 2 in the present embodiment. FIG. 1B is a schematic view of a cross-section 2*cs* of a permanent magnet 2. FIG. 2 is an enlarged view of a portion of the cross-section 2*cs* of a permanent magnet 2 (region II). Although the permanent magnet 2 shown in FIG. 1A is in a rectangular parallelepiped shape, the shape of the permanent magnet 2 is not limited to a rectangular parallelpiped. The dimensions and the shape of a permanent magnet 2 are various depending on the use of the permanent magnet 2 without specific limitations. The shape of the permanent magnet 2 may be, for example, cubic, rectangular (tabular), polygonal column, arc segmented, fan-shaped, annular sectorial, spherical, disk-shaped, cylindrical, ring-shaped or capsule. The shape of the cross-section of the permanent magnet 2 may be, for example, polygonal, arc-like (circular chord-like), bow-shaped, arch-shaped, or circular.

The permanent magnet 2 comprises rare-earth elements R, transition metal elements T and boron B. The permanent magnet 2 may be reworded as a neodymium magnet.

At least some of the rare-earth elements R are neodymium (Nd) and at least one of terbium (Tb) and dysprosium (Dy). In other words, the permanent magnet 2 comprises Nd, and further comprises at least one of Tb and Dy. The permanent magnet 2 may further comprise a rare-earth element other than Nd, Tb and Dy. For example, the permanent magnet 2 may further comprise at least one selected from the group consisting of scandium (Sc), yttrium (Y), lanthanum (La), cerium (Ce), praseodymium (Pr), promethium (Pm), samarium (Sm), europium (Eu), gadolinium (Gd), holmium (Ho), erbium (Er), thulium (Tm), ytterbium (Yb) and lutetium (Lu) as another rare-earth element. The rare-earth elements R contained in the permanent magnet 2 may be only Nd and at least one of Tb and Dy.

At least some of the transition metal elements T are iron (Fe). T may be Fe and cobalt (Co). All of T may be Fe. All of T may be Fe and Co. The permanent magnet 2 may further comprise transition metal elements other than Fe and Co. The following T described below mean Fe alone, or Fe and Co.

As shown in FIG. 2, the permanent magnet 2 comprises a plurality of (many) main phase grains 4. The main phase grains 4 comprise at least Nd, Fe and B. The main phase grains 4 may comprise a crystal of $R_2T_{14}B$, with at least some of R being Nd and at least some of T being Fe. A part of or the whole of the main phase grains 4 may consist of a crystal (single crystal or polycrystal) of $R_2T_{14}B$. $R_2T_{14}B$ may be, for example, $Nd_2Fe_{14}B$. Some of Nd in $Nd_2Fe_{14}B$ may be substituted with at least one of Pr, Tb and Dy. Some of Fe in $Nd_2Fe_{14}B$ may be substituted with Co. The main phase grains 4 may comprise other elements in addition to R, T and B. The internal composition of the main phase grains 4 may be uniform. The internal composition of the main phase grains 4 may be non-uniform.

The permanent magnet 2 comprises a plurality of grain boundary triple points 6. The grain boundary triple point 6 is a grain boundary phase surrounded by at least three main phase grains 4. The permanent magnet 2 comprises a plurality of two-grain boundaries 10 as well. The two-grain boundary 10 is a grain boundary phase located between two neighboring main phase grains 4. The composition of some of or all of the grain boundary triple points 6 may be uniform. For example, each of the grain boundary triple points 6 may be formed of an intermetallic compound. Each of the grain boundary triple points 6 may be formed of a eutectic. Each of the grain boundary triple points 6 may be formed of an alloy. The composition of some of or all of the grain boundary triple points 6 may be non-uniform. For example, each of the grain boundary triple points 6 may comprise plural types of intermetallic compounds. Each of the grain boundary triple points 6 may comprise plural types of eutectics. Each of the grain boundary triple points 6 may comprise plural types of alloys. Each of the grain boundary triple points 6 may comprise one or more types of intermetallic compounds and one or more types of eutectics. Each of the grain boundary triple points 6 may comprise one or more types of eutectics and one or more types of alloys. Each of the grain boundary triple points 6 may comprise one or more types of intermetallic compounds and one or more types of alloys. Each of the grain boundary triple points 6 may comprise one or more types of intermetallic compounds, one or more types of eutectics, and one or more types of alloys.

At least some of the grain boundary triple points 6 comprise at least one of Nd and Pr, at least one of Tb and Dy, at least one of Fe and Co, and copper (Cu). All of the grain boundary triple points 6 may comprise at least one of Nd and Pr, at least one of Tb and Dy, at least one of Fe and Co, and Cu. For the convenience of explanation, one or both of Nd and Pr are expressed as RL. One or both of Tb and Dy are expressed as RH. In the case based on these notations, at least some of the grain boundary triple points 6 comprise RL, RH, T and Cu. The grain boundary triple points 6 may further comprise other elements in addition to RL, RH, T and Cu.

The average content of Nd in grain boundary triple points 6 is expressed as [Nd] atom %. [Nd] is the average content of Nd measured in each of a plurality of grain boundary triple points 6. The average content of Pr in grain boundary triple points 6 is expressed as [Pr] atom %. [Pr] is the average content of Pr measured in each of a plurality of grain boundary triple points 6. The average content of Tb in grain boundary triple points 6 is expressed as [Tb] atom %. [Tb] is the average content of Tb measured in each of a plurality of grain boundary triple points 6. The average content of Dy in grain boundary triple points 6 is expressed as [Dy] atom %. [Dy] is the average content of Dy measured in each of a plurality of grain boundary triple points 6. The average content of Fe in grain boundary triple points 6 is expressed as [Fe] atom %. [Fe] is the average content of Fe measured in each of a plurality of grain boundary triple points 6. The average content of Co in grain boundary triple points 6 is expressed as [Co] atom %. [Co] is the average content of Co measured in each of a plurality of grain boundary triple points 6. The average content of Cu in grain boundary triple points 6 is expressed as [Cu] atom %. [Cu] is the average content of Cu measured in each of a plurality of grain boundary triple points 6.

[Nd], [Pr], [Fe] and [Co] satisfy the following inequality 1, and [Tb], [Dy] and [Cu] satisfy the following inequality 2.

$$2.00 \leq ([Fe]+[Co])/([Nd]+[Pr]) \leq 5.00 \quad (1)$$

$$1.00 \leq [Cu]/([Tb]+[Dy]) \leq 4.00 \quad (2)$$

Due to satisfying the inequality 1 and the inequality 2, the permanent magnet 2 is able to have excellent magnetic properties. The reason is as follows.

The permanent magnet 2 is made from a magnet base material containing many main phase grains 4 bounded to each other and a diffusing material containing RH. By a diffusion step of heating the magnet base material with the diffusing material adhering thereto, RH in the diffusing material diffuses from the surface of the magnet base material to the internal part of the magnet base material. In the diffusion step where grain boundary triple points 6 satisfying the inequalities 1 and 2 are formed, RH is hardly fixed in the grain boundary triple point 6, while RH is easily fixed in the two-grain boundary 10 and the vicinity of the surface of the main phase grain 4. In other words, in the diffusion step where the grain boundary triple points 6 satisfying the inequalities 1 and 2 are formed, RH is hardly fixed to the grain boundary triple point 6, so that RH easily diffuses to the two-grain boundary 10 and the vicinity of the surface of the main phase grain 4, and a part of Nd are easily substituted with RH in the two-grain boundary 10 and the vicinity of the surface of the main phase grain 4. As a result, RH is easily localized in the two-grain boundary 10 and in the vicinity of the surface of the main phase grain 4, so that an anisotropic magnetic field locally increases in the vicinity of the two-grain boundary 10 and magnetization reversal nucleus hardly occurs in the vicinity of the two-grain boundary 10, resulting in the increase in the coercivity of a permanent magnet 2. Also, in the case where the average composition of the grain boundary triple points 6 satisfy the inequalities 1 and 2, the coercivity of the permanent magnet 2 is able to be increased and the RH content in the whole of the permanent magnet 2 is able to be reduced in comparison with a conventional permanent magnet as well. Due to the reduction in the RH content, the residual magnetic flux density of the permanent magnet 2 hardly decreases. The permanent magnet 2 in the present embodiment, therefore, is able to have excellent magnetic properties. In other words, both of the high residual magnetic flux density and the high coercivity of the permanent magnet 2 can be achieved.

In the case where RH in the diffusing material diffuses into the internal part (deep part) of the main phase grain 4 in the diffusion step, Nd in the main phase grain is substituted with RH too much, so that the magnetic properties of the main phase grain 4 are impaired. It is therefore necessary that in the diffusion step, the magnet base material with a diffusing material adhered thereto is heated at a low temperature allowing the diffusion of RH into the internal part of the main phase grain 4 to be suppressed. In the case where the grain boundary triple point 6 comprises a phase containing T and RL (T-RL phase) and the average composition of the grain boundary triple points 6 satisfies the inequality 1, the melting point (or eutectic point) of the T-RL phase is relatively low, so that the T-RL phase tends to be a liquid phase at relatively low temperature. As a result, RH is hardly fixed to the grain boundary triple point 6 in comparison with the case without a T-RL phase, and RH easily diffuses into the two-grain boundary 10 and the vicinity of the surface of the main phase grain 4 through the T-RL phase (liquid phase). For example, a part of or the whole of grain boundary triple points 6 may comprise an intermetallic compound as the T-RL phase, and the intermetallic compound may be at least one selected from the group consisting of $NdFe_5$ and $Nd_5Fe_{17}$. A part of or the whole of the grain boundary triple points 6 may comprise a eutectic as the T-RL phase, and the eutectic may comprise at least one of Fe and Co and at least one of Nd and Pr. A part of or the whole of the grain boundary triple points 6 may comprise an alloy as the T-RL phase, and the alloy may comprise at least one of Fe and Co and at least one of Nd and Pr.

In the case where the grain boundary triple point 6 comprises a phase containing Cu and RH (Cu-RH phase) and the average composition of the grain boundary triple points 6 satisfies the inequality 2, the melting point (or eutectic point) of the Cu-RH phase is relatively low, so that the Cu-RH phase tends to be a liquid phase at a relatively low temperature. As a result, RH is hardly fixed to the grain boundary triple point 6 in comparison with the case without the Cu-RH phase, and RH easily diffuses to the two-grain boundary 10 and the vicinity of the surface of the main phase grain 4 through the Cu-RH phase (liquid phase). A part of or the whole of the grain boundary triple points 6 may comprise a intermetallic compound as the Cu-RH phase, and the intermetallic compound may be at least one selected from the group consisting of $Cu_7Tb_2$ and $Cu_2Tb$. A part of or the whole of the grain boundary triple points 6 may comprise a eutectic as the Cu-RH phase, and the eutectic may comprise Cu and at least one of Dy and Tb. A part of or the whole of the grain boundary triple points 6 may comprise an alloy as the Cu-RH phase, and the alloy may comprise Cu and at least one of Dy and Tb.

The reason of improvement in magnetic properties of the permanent magnet 2 through satisfaction of the inequalities 1 and 2 is not limited to the mechanism described above.

As magnetic properties of the permanent magnet 2 are easily improved, [Nd], [Pr], [Fe] and [Co] may satisfy one inequality selected from the following group consisting of 1A, 1B, 1C, 1D, 1E, 1F, 1G, 1H, 1I, 1J, 1K, 1L, 1M, 1N and 1O, and [Tb], [Dy] and [Cu] may satisfy one inequality selected from the following group consisting of 2A, 2B, 2C, 2D, 2E, 2F, 2G, 2H, 2I, 2 J, 2K, 2L, 2M, 2N, 2O and 2P.

$$2.03 \leq ([Fe]+[Co])/([Nd]+[Pr]) \leq 5.00 \quad (1A)$$

$$2.05 \leq ([Fe]+[Co])/([Nd]+[Pr]) \leq 5.00 \quad (1B)$$

$$2.12 \leq ([Fe]+[Co])/([Nd]+[Pr]) \leq 5.00 \quad (1C)$$

$$2.00 \leq ([Fe]+[Co])/([Nd]+[Pr]) \leq 4.00 \quad (1D)$$

$$2.03 \leq ([Fe]+[Co])/([Nd]+[Pr]) \leq 4.00 \quad (1E)$$

$$2.05 \leq ([Fe]+[Co])/([Nd]+[Pr]) \leq 4.00 \quad (1F)$$

$$2.12 \leq ([Fe]+[Co])/([Nd]+[Pr]) \leq 4.00 \quad (1G)$$

$$2.00 \leq ([Fe]+[Co])/([Nd]+[Pr]) \leq 3.97 \quad (1H)$$

$$2.03 \leq ([Fe]+[Co])/([Nd]+[Pr]) \leq 3.97 \quad (1I)$$

$$2.05 \leq ([Fe]+[Co])/([Nd]+[Pr]) \leq 3.97 \quad (1J)$$

$$2.12 \leq ([Fe]+[Co])/([Nd]+[Pr]) \leq 3.97 \quad (1K)$$

$$2.00 \leq ([Fe]+[Co])/([Nd]+[Pr]) \leq 3.50 \quad (1L)$$

$$2.03 \leq ([Fe]+[Co])/([Nd]+[Pr]) \leq 3.50 \quad (1M)$$

$$2.05 \leq ([Fe]+[Co])/([Nd]+[Pr]) \leq 3.50 \quad (1N)$$

$$2.12 \leq ([Fe]+[Co])/([Nd]+[Pr]) \leq 3.50 \quad (1O)$$

$$1.20 \leq [Cu]/([Tb]+[Dy]) \leq 4.00 \quad (2A)$$

$$2.00 \leq [Cu]/([Tb]+[Dy]) \leq 4.00 \quad (2B)$$

$$2.06 \leq [Cu]/([Tb]+[Dy]) \leq 4.00 \quad (2C)$$

$$1.00 \leq [Cu]/([Tb]+[Dy]) \leq 3.50 \quad (2D)$$

$$1.20 \leq [Cu]/([Tb]+[Dy]) \leq 3.50 \quad (2E)$$

$$2.00 \leq [Cu]/([Tb]+[Dy]) \leq 3.50 \quad (2F)$$

$$2.06 \leq [Cu]/([Tb]+[Dy]) \leq 3.50 \quad (2G)$$

$$1.00 \leq [Cu]/([Tb]+[Dy]) \leq 3.00 \quad (2H)$$

$$1.20 \leq [Cu]/([Tb]+[Dy]) \leq 3.00 \quad (2I)$$

$$2.00 \leq [Cu]/([Tb]+[Dy]) \leq 3.00 \quad (2J)$$

$$2.06 \leq [Cu]/([Tb]+[Dy]) \leq 3.00 \quad (2K)$$

$$1.00 \leq [Cu]/([Tb]+[Dy]) \leq 2.80 \quad (2L)$$

$$1.20 \leq [Cu]/([Tb]+[Dy]) \leq 2.80 \quad (2M)$$

$$2.00 \leq [Cu]/([Tb]+[Dy]) \leq 2.80 \quad (2N)$$

$$2.06 \leq [Cu]/([Tb]+[Dy]) \leq 2.80 \quad (2O)$$

$$1.20 \leq [Cu]/([Tb]+[Dy]) \leq 2.06 \quad (2P)$$

As magnetic properties of the permanent magnet 2 are easily improved, [Tb] and [Cu] may satisfy one inequality selected from the following group consisting of 3A, 3B, 3C, 3D, 3E, 3F, 3G and 3H.

$$2.00 \leq [Cu]/[Tb] \leq 4.00 \quad (3A)$$

$$2.06 \leq [Cu]/[Tb] \leq 4.00 \quad (3B)$$

$$2.73 \leq [Cu]/[Tb] \leq 4.00 \quad (3C)$$

$$2.75 \leq [Cu]/[Tb] \leq 4.00 \quad (3D)$$

$$2.00 \leq [Cu]/[Tb] \leq 3.50 \quad (3E)$$

$$2.06 \leq [Cu]/[Tb] \leq 3.50 \quad (3F)$$

$$2.73 \leq [Cu]/[Tb] \leq 3.50 \quad (3G)$$

$$2.75 \leq [Cu]/[Tb] \leq 3.50 \quad (3H)$$

The average [Nd] of Nd content in the grain boundary triple points 6 may be 10 atom % or more and 25 atom % or less. The average [Pr] of Pr content in the grain boundary triple points 6 may be 0.1 atom % or more and 6.0 atom % or less. The average [Tb] of Tb content in the grain boundary triple points 6 may be 0.05 atom % or more and 3.0 atom % or less. The average [Dy] of Dy content in the grain boundary triple points 6 may be 0.05 atom % or more and 2.4 atom % or less. The average [Fe] of Fe content in the grain boundary triple points 6 may be 31 atom % or more and 75 atom % or less. The average [Co] of Co content in the grain boundary triple points 6 may be 0.1 atom % or more and 3.0 atom % or less. The average [Cu] of Cu content in the grain boundary triple points 6 may be 0.5 atom % or more and 5.0 atom % or less. In the case where [Nd], [Pr], [Tb], [Dy], [Fe], [Co] and [Cu] are in the ranges, respectively, the inequalities 1 and 2 are easily satisfied, so that magnetic properties of the permanent magnet 2 are easily improved.

The total content of Tb and Dy in the whole permanent magnet 2 may be 0.20% by mass or more and 5.00% by mass or less. In some cases, the total content of Tb and Dy in the whole permanent magnet is expressed as $C_{Tb+Dy}$. In the case where the permanent magnet 2 has a $C_{Tb+Dy}$ of 0.20% by mass or more, magnetic properties (in particular, coercivity) of the permanent magnet 2 is easily improved. Also, in the case where the permanent magnet 2 has a $C_{Tb+Dy}$ in the above-described range, the permanent magnet 2 in the present embodiment tends to have superior magnetic properties in comparison with a conventional permanent magnet having the same $C_{Tb+Dy}$. In other words, even in the case where the $C_{Tb+Dy}$ of the permanent magnet 2 in the present embodiment is equal to or smaller than the $C_{Tb+Dy}$ of a conventional permanent magnet, it is possible that the permanent magnet 2 in the present embodiment has superior magnetic properties in comparison with a conventional permanent magnet. Namely, according to the permanent magnet 2 in the present embodiment, it is possible to reduce $C_{Tb+Dy}$ than the $C_{Tb+Dy}$ of a conventional permanent magnet without impairing magnetic properties. For the same reason, the total content of Tb and Dy in the whole permanent magnet 2 may be 0.20% by mass or more and 2.00% by mass or less, 0.20% by mass or more and 1.50% by mass or less, 0.20% by mass or more and 1.00% by mass or less, 0.20% by mass or more and 0.90% by mass or less, 0.20% by mass or more and 0.60% by mass or less, 0.20% by mass or more and 0.50% by mass or less, or 0.20% by mass or more and 0.40% by mass or less.

The total content of Nd, Pr, Tb and Dy in the whole of the permanent magnet 2 may be 27.00% by mass or more and 33.00% by mass or less. In the case where the total content of Nd, Pr, Tb and Dy is 27.00% by mass or more, the coercivity of the permanent magnet 2 is easily increased. In the case where the total content of Nd, Pr, Tb and Dy is 33.00% by mass or less, the residual magnetic flux density is easily increased.

The Cu content in the whole of the permanent magnet 2 may be 0.04% by mass or more and 0.50% by mass or less. In the case where the Cu content is 0.04% by mass or more, the coercivity of the permanent magnet 2 is easily increased, and the corrosion resistance of the permanent magnet 2 is easily improved. In the case where the Cu content is 0.50% by mass or less, the coercivity and the residual magnetic flux density of the permanent magnet 2 is easily increased.

The gallium (Ga) content in the whole of the permanent magnet 2 may be 0.03% by mass or more and 0.30% by mass or less. In the case where the Ga content is 0.03% by mass or more, the coercivity of the permanent magnet 2 is easily increased. In the case where the Ga content is 0.30% by mass or less, formation of a subphase (for example, a phase comprising R, T and Ga) is suppressed, so that the residual magnetic flux density of the permanent magnet 2 is easily increased.

The Co content in the whole of the permanent magnet 2 may be 0.30% by mass or more and 3.00% by mass or less. In the case where the Co content is 0.30% by mass or more, the corrosion resistance of the permanent magnet 2 is easily increased. In the case where the Co content is more than 3.00% by mass, the effect for improving the corrosion resistance of the permanent magnet reaches a plateau, so that no advantage appropriate for the cost of Co is obtained.

The aluminum (Al) content in the whole of the permanent magnet 2 may be 0.15% by mass or more and 0.30% by mass or less. In the case where the Al content is 0.15% by mass or more, the coercivity of the permanent magnet 2 is easily increased. Also, in the case where the Al content is 0.15% by mass or more, the amount of change in magnetic properties (in particular, coercivity) of the permanent magnet 2 due to the temperature change in the aging or the heat treatment described below tends to be small, so that the variation in magnetic properties of mass-produced permanent magnets 2 tends to be suppressed. In the case where the Al content is 0.30% by mass or less, the residual magnetic flux density of the permanent magnet 2 is easily increased. Also, in the case where the Al content is 0.30% by mass or less, the change in the coercivity due to change in temperature tends to be suppressed.

The zirconium (Zr) content in the whole of the permanent magnet 2 may be 0.10% by mass or more and 1.00% by mass or less. In the case where the Zr content is 0.10% by mass or more, abnormal grain growth of the main phase grain in the sintering step described below is easily suppressed, the squareness ratio (Hk/HcJ) of the permanent magnet 2 easily approaches 1.0, and the permanent magnet 2 is easily magnetized under a low magnetic field. Hk means the strength of a magnetic field corresponding to 90% of the residual magnetic flux density (Br). In the case where the Zr content is 1.00% by mass or less, the residual magnetic flux density of the permanent magnet 2 is easily increased.

The manganese (Mn) content in the whole of the permanent magnet 2 may be 0.02% by mass or more and 0.10% by mass or less. In the case where the Mn content is 0.02% by mass or more, the residual magnetic flux density and the coercivity of the permanent magnet 2 are easily increased. In the case where the Mn content is 0.10% by mass or less, the coercivity of the permanent magnet 2 is easily increased.

The B content in the whole of the permanent magnet 2 may be 0.85% by mass or more and 1.05% by mass or less. In the case where the B content is 0.85% by mass or more, the residual magnetic flux density of the permanent magnet 2 is easily increased. In the case where the B content is 1.05% by mass or less, the coercivity of the permanent magnet 2 is easily increased. With a B content within the range, the squareness ratio of the permanent magnet 2 easily approaches 1.0.

The permanent magnet 2 may comprise at least one selected from the group consisting of carbon (C), nitrogen (N), oxygen (O), calcium (Ca), nickel (Ni), silicon (Si), chlorine (Cl), sulfur (S) and fluorine (F) in addition to the elements described above.

The balance excluding the elements described above in the permanent magnet 2 may be Fe.

The average grain size of the main phase grains 4 is not particularly limited, and may be, for example, 1.0 μm or more and 10.0 μm or less. The total volume ratio of the main phase grains 4 in the permanent magnet 2 is not particularly limited, and may be, for example, 75% by volume or more and less than 100% by volume.

Each of the compositions of the main phase grain 4 and the grain boundary triple point 6 may be identified by analysis of the cross section 2*cs* of the permanent magnet 2 using energy dispersive X-ray spectrometry (EDS). The composition of the whole permanent magnet 2 may be identified, for example, by an analytical method such as X-ray fluorescence spectroscopy (XRF), inductivity coupled plasma emission spectrometry (ICP), inert gas fusion-non-dispersive infrared absorption spectrometry, combustion in oxygen stream-infrared absorption spectrometry, and inert gas fusion-thermal conductivity method.

The permanent magnet 2 in the present embodiment may be used in various fields such as hybrid vehicles, electric vehicles, hard disk drives, magnetic resonance imaging apparatuses (MRI), smart phones, digital cameras, flat-panel TV sets, scanners, air conditioners, heat pumps, refrigerators, vacuum cleaners, washing and drying machines, elevators and wind power generators. The permanent magnet 2 in the present embodiment may be used as a material to compose a motor, a generator or an actuator.

(Method for Manufacturing Permanent Magnet)

An example of the method for manufacturing the permanent magnet described above is described in the following.

A raw material alloy may be made from metals (raw material metals) containing each of the elements to compose the permanent magnet by strip casting or the like. The raw material alloy comprises at least Nd, Fe and B. The raw material alloy may comprise Pr. The raw material alloy may not comprise Pr. The raw material alloy may comprise one or both of Tb and Dy. The raw material alloy may not comprise one or both of Tb and Dy. The raw material alloy may comprise Co. The raw material alloy may not comprise Co. The raw material alloy may comprise Cu. The raw material alloy may not comprise Cu. The raw material metal may be, for example, a simple substance of rare-earth element (simple substance of metal); an alloy containing a rare-earth element; pure iron; ferroboron or an alloy containing these. These raw material metals are weighed corresponding to the composition of a desired magnet base material. As the raw material alloy, two or more types of alloys having a different composition may be prepared.

[Pulverization Step]

The raw material alloy described above may be pulverized in non-oxidizing atmosphere to prepare an alloy powder. The raw material alloy may be pulverized in two steps including a coarse pulverization step and a fine pulverization step. In the coarse pulverization step, a pulverizing method using, for example, a stamp mill, a jaw crusher or a Brown mill, may be used. The coarse pulverization step may be performed in an inert gas atmosphere. After hydrogen is stored into a raw material alloy, the raw material alloy may be pulverized. In other words, hydrogen storage pulverization may be performed as the coarse pulverization step. In the coarse pulverization step, the raw material alloy may be pulverized into a particle size of about several hundred μm. In a fine pulverization step subsequent to the coarse pulverization step, the raw material alloy after going through the coarse pulverization step may be further pulverized into an average particle size of several μm. In the fine pulverization step, for example, a jet mill may be used. The raw material alloy may be pulverized in one pulverization step alone. For example, a fine pulverization step only may be performed. In the case where a plurality of raw material alloys are used, each of the raw material alloys may be separately pulverized and then mixed. The alloy powder may comprise at least one lubricant (pulverizing aid) selected from the group consisting of a fatty acid, a fatty acid ester and a metal salt of fatty acid (metal soap). In other words, the raw material alloy may be pulverized together with a lubricant (pulverizing aid).

[Molding Step]

In a molding step, an alloy powder is molded in a magnetic field, so that a green compact comprising the alloy powder oriented along the magnetic field may be obtained. For example, while applying a magnetic field to the alloy powder in a mold, the alloy powder is pressurized in the mold, so that a green compact may be obtained. The pressure applied to the alloy powder in the mold may be 20 MPa or more and 300 MPa or less. The strength of the magnetic field applied to the alloy powder may be 950 kA/m or more and 1600 kA/m or less.

[Sintering Step]

In a sintering step, the green compact is sintered in vacuum or in an inert gas atmosphere, so that a sintered body may be obtained. Sintering conditions may be appropriately set depending on the composition of a target permanent magnet, the pulverizing method and the particle size of raw material alloy, etc. The sintering temperature may be, for example, 1000° C. or more and 1200° C. or less. The sintering time may be 1 hour or more and 20 hours or less.

[Aging Step]

In an aging step, the sintered body may be heated at a temperature lower than the sintering temperature. In an aging step, the sintered body may be heated in vacuum or in an inert gas atmosphere. A diffusion step described below may be combined with the aging step. In that case, an aging step separate from the diffusion step may not be performed.

The aging step may comprise a first aging step and a second aging step subsequent to the first aging step. In the first aging step, a sintered body may be heated at 700° C. or more and 900° C. or less. The time for the first aging may be 1 hour or more and 10 hours or less. In the second aging step, a sintered body may be heated at 500° C. or more and 700° C. or less. The time for the second aging may be 1 hour or more and 10 hours or less.

After the steps described above, a sintered body is obtained. The sintered body is a magnet base material for use in the following diffusion step. The magnet base material is subjected to a diffusion step, so that a permanent magnet is obtained. Prior to the diffusion step, the dimensions and the shape of the magnet base material may be adjusted by a processing method such as cutting and polishing. The magnet base material (sintered body) comprises a plurality of (many) main phase grains sintered to each other. The average composition of the main phase grains included in the magnet base material, however, is different from the average composition of the main phase grains included in the completed permanent magnet. The main phase grains in the magnet base material comprise at least Nd, Fe and B. The main phase grains may comprise a $R_2T_{14}B$ crystal, wherein at least some of R may be Nd, and at least some of T may be Fe. A part of or the whole of the main phase grains may consist of $R_2T_{14}B$ crystal (single crystal or polycrystal). $R_2T_{14}B$ may be, for example, $Nd_2Fe_{14}B$. Some of Nd in $Nd_2Fe_{14}B$ may be substituted with any one of Tb and Dy. Some of Fe in $Nd_2Fe_{14}B$ may be substituted with Co. The main phase grain may further comprise another element in addition to R, T and B. The magnet base material comprises a plurality of grain boundary triple points as well. The average composition of the grain boundary triple points included in the magnet base material, however, is different from the average composition of the grain boundary triple points included in the completed permanent magnet. The magnet base material comprises a plurality of two-grain boundaries as well. The average composition of the two-grain boundaries included in the magnet base material, however, is different from the average composition of the two-grain boundaries included in the completed permanent magnet. The grain boundary phase may comprise at least Nd, and the Nd content in the grain boundary phase may be larger than the Nd content in the main phase grain. In other words, the grain boundary phase may be a Nd-rich phase. The grain boundary phase may comprise at least one of Fe and B in addition to Nd.

[Diffusion Step]

In a diffusion step, a diffusing material is adhered to the surface of the magnet base material, and the magnet base material with the diffusing material adhered thereto is heated. The diffusing material may comprise a first component, a second component and a third component described below, and each of the first component, the second component and the third component may be powder. The diffusing material may further comprise another component in addition to the first component, the second component and the third component. For the convenience of the following explanation, one or both of Tb and Dy are expressed as RH. One or both of Nd and Pr are expressed as RL.

The first component may be at least one of a simple substance of Tb and a simple substance of Dy. As long as no alloy is formed from RH and RL, the first component may contain an extremely small amount of RL. In other words, the first component may contain RL and other elements as unavoidable impurities. The alloy is at least any one of a solid solution, a eutectic and an intermetallic compound.

In the case where the first component is at least any one of the simple substance of Tb and the simple substance of Dy, the first component is able to be easily made only by pulverization of the simple substance of metal. In other words, in the case where the first component is at least any one of the simple substance of Tb and the simple substance of Dy, a process for making an alloy comprising RH or an alloy comprising RH and RL is unnecessary, and a process for pulverizing an alloy which is harder than the simple substance is also unnecessary. Since making and pulverizing of the alloy is unnecessary, the manufacturing cost of a permanent magnet is reduced.

The second component may be a metal comprising at least one of Nd and Pr and none of Tb and Dy. For example, the second component may be at least one selected from the group consisting of a simple substance of Nd, a simple substance of Pr, and an alloy comprising Nd and Pr. The alloy comprising Nd and Pr may comprise at least one element excluding Tb and Dy from the elements described above which may be included in a permanent magnet. The second component may be an alloy consisting of Nd and Pr. As long as no alloy is formed from RH and RL, the second component may comprise an extremely small amount of RH. In other words, the second component may contain RH and other elements as unavoidable impurities.

In the case where the second component is at least one of the simple substance of Nd and the simple substance of Pr, the second component is able to be easily made only by pulverization of the simple substance of metal. In other words, in the case where the second component is at least any one of the simple substance of Nd and the simple substance of Pr, a process for making an alloy comprising RL or an alloy comprising RH and RL is unnecessary, and a process for pulverizing an alloy which is harder than the simple substance is also unnecessary. Since making and pulverizing of the alloy is unnecessary, the manufacturing cost of a permanent magnet is reduced.

Each of the first component and the second component may be a hydride. In other words, the first component may be at least one of a hydride of Tb and a hydride of Dy. The second component may be at least one of a hydride of Nd and a hydride of Pr. The hydride of Tb may be, for example, at least one of $TbH_2$ and $TbH_3$. The hydride of Tb may be, for example, a hydride of alloy consisting of Tb and Fe. The hydride of Dy may be, for example, at least one of $DyH_2$ and $DyH_3$. The hydride of Dy may be, for example, a hydride of alloy consisting of Dy and Fe. The hydride of Tb and the hydride of Dy may be, for example, a hydride of an alloy consisting of Tb, Dy and Fe. The hydride of Nd may be, for example, at least one of $NdH_2$ and $NdH_3$. The hydride of Pr may be, for example, at least one of $PrH_2$ and $PrH_3$. The hydride of Nd and the hydride of Pr may be a hydride of alloy consisting of Nd and Pr.

The third component may be at least one selected from the group consisting of a simple substance of Cu, an alloy comprising Cu, and a compound of Cu, and the third component may comprise none of Nd, Pr, Tb and Dy. The alloy comprising Cu may comprise at least one element excluding Nd, Pr, Tb and Dy from the elements described above which may be included in a permanent magnet. The compound of copper may be at least one selected from the group consisting of a hydride and oxide. The hydride of Cu may be, for example, CuH. The oxide of Cu may be at least any one of $Cu_2O$ and CuO.

Each of the first component, the second component and the third component may be made through a coarse pulverization step and a fine pulverization step. The methods of the coarse pulverization step and the fine pulverization step are the same as those of the pulverization steps of the raw material alloy described above. The first component, the second component or the third component may be pulverized together at the same time. Through the coarse pulverization step and the fine pulverization step, the particle size of the first component, the second component and the third component each may be freely controlled. For example, after hydrogen is stored into a simple substance of metal, the simple substance of metal may be dehydrogenated. As a result, a coarse powder of metal hydride is obtained. The coarse hydride powder is further pulverized by a jet mill, so that a fine powder of metal hydride is obtained. The fine powder may be used as the first component, the second component or the third component.

Even in the case where the diffusing material comprises the first component only among the first component, the second component and the third component, it is possible to manufacture a permanent magnet in the present embodiment. However, a diffusing material further comprising the second component and the third component in addition to the first component easily satisfies the inequalities 1 and 2, so that the magnetic properties of a permanent magnet are easily further improved.

By heating the magnet base material with a diffusing material adhered thereto, RH derived from the first component diffuses into the internal part of the magnet base material, RL derived from the second component diffuses into the internal part of the magnet base material, and Cu derived from the third component diffuses into the internal part of the magnet base material. The present inventors presume that RH, RL and Cu diffuse from the surface of the magnet base material into the internal part of the magnet base material by the following mechanism. The diffusion mechanism, however, is not limited to the following mechanism.

In the case where an alloy comprising RH and RL is used as diffusing material, the alloy adhered to the surface of the magnet base material melts easily and rapidly at the eutectic point of RH and RL. As a result, the alloy in liquid phase stagnates easily on the surface of the magnet base material, so that RH in the liquid phase hardly diffuses into the internal part of the magnet base material. In other words, a large amount of RH stagnates easily on the surface of the magnet base material. RH diffuses into the internal part of the main phase grains located in the vicinity of the surface of the magnet base material, so that the magnet properties of the main phase grains located in the vicinity of the surface of the magnet base material are impaired, resulting in reduction in the residual magnetic flux density of a permanent magnet.

In contrast, in the case where the diffusing material comprises the first component (RH), the second component (RL) and the third component (Cu), the melting point of the second component is lower than the melting point of the third component and the melting point of the third component is lower than the melting point of the first component, so that the second component tends to melt faster than the third component and the third component tends to melt faster than the first component. For example, the melting point of Nd is about 1024° C., the melting point of Pr is about 935° C., the melting point of Cu is about 1085° C., the melting point of Tb is about 1356° C., and the melting point of Dy is about 1407° C. RL derived from the second component which melts first diffuses into the internal part of the magnet base material through grain boundaries of the magnet base material. In the grain boundaries of the magnet base material (grain boundary triple points and two-grain boundaries), RL is present in liquid phase. A part of Nd in the main phase grains originally contained in the magnet base material (one of RL) also seeps into the grain boundaries. In other words, from RL derived from the second component and Nd derived from the main phase grains, an ample liquid phase of RL is formed. Since the third component easily melts next to the second component, Cu derived from the third component is able to diffuse into the internal part of the magnet base material at a fast diffusion rate due to interposition of the liquid phase of RL located in the grain boundaries. Cu is easily localized in the grain boundaries where the liquid phase of RL is present (grain boundary triple points and two-grain boundaries). The first component tends to melt last, so that RH derived from the first component is substituted with RL in liquid phase located in the vicinity of the surface of the magnet base material, and RH diffuses into the internal part of the magnet base material. Since Cu diffuses in the grain boundary triple points ahead of RH, RH is hardly trapped in the grain boundary triple points. Since Cu located in the two-grain boundaries functions as a path for RH, RH easily diffuses into the two-grain boundaries. Due to Cu located in the two-grain boundaries, excessive diffusion of RH into the internal part of the main phase grains is suppressed in comparison with the case of absence of Cu. Due to RH undergoing the diffusion process described above, RH is easily localized in the two-grain boundaries and in the vicinity of the surface of the main phase grains, so that an anisotropic magnetic field grows larger locally in the vicinity of the two-grain boundaries and the magnetization reversal nuclei hardly occur in the vicinity of two-grain boundaries, resulting in increase of coercivity of the permanent magnet.

Since the diffusing material comprises the second component (RL) and the third component (Cu) each having a lower melting point than the first component (RH), RH more easily diffuses into the two-grain boundaries at lower temperature in comparison with the case where the diffusing material is made of the first component alone, and RH more easily diffuses into the two-grain boundaries in a shorter time. As a result, in comparison with the case where the diffusing material is made of the first component alone, the temperature and the time required for the diffusion of RH are reduced, so that the excessive diffusion of RH into the internal part (deep part) of the main phase grains is suppressed. Due to the presence of RL derived from the second component as the liquid phase in the grain boundaries (grain boundary triple points and two-grain boundaries), in comparison with a diffusing material containing no second component, Nd in the main phase grains does not excessively seep into the grain boundaries, and Nd in the main phase grains is not excessively substituted with RH. For these reasons, the degradation of magnetic properties of each of the main phase grains is suppressed and the reduction in the residual magnetic flux density of a permanent magnet is suppressed.

Since the diffusing material comprises the second component (RL) and the third component (Cu) each having a lower melting point than the first component (RH), RH is able to more certainly diffuse into the two-grain boundaries in comparison with a diffusing material made of the first component (RH) alone. As a result, in comparison with a diffusing material of the first component (RH) alone, the amount of the first component (RH) required for increasing the coercivity of a permanent magnet is reduced, so that the manufacturing cost of a permanent magnet is reduced.

In the diffusion step, a slurry containing the first component, the second component, the third component and a solvent may be adhered to the surface of the magnet base material, as the diffusing material. A slurry is a mixture in liquid state. The solvent in the slurry may be a solvent other than water. The solvent may be an organic solvent such as an alcohol, an aldehyde and a ketone. In order to allow the diffusing material to easily adhere to the surface of the magnet base material, the diffusing material may further contain a binder. The slurry may comprise the first component, the second component, the third component, the solvent and the binder. By mixing the first component, the second component, the third component, the binder and the solvent, a paste having a higher viscosity than the slurry may be formed, and the paste may be adhered to the surface of the magnet base material. A paste is a mixture having fluidity and high viscosity. Prior to the diffusion step, the magnet base material with a slurry or a paste adhered thereto may be heated to remove the solvent contained in the slurry or the paste.

The diffusing material may be adhered to a part of or the whole of the surface of the magnet base material. The adhesion method of the diffusing material is not limited. For example, the slurry or the paste described above may be applied to the surface of the magnet base material. The diffusing material itself or the slurry may be sprayed onto the surface of the magnet base material. The diffusing material may be vapor-deposited on the surface of the magnet base material. The magnet base material may be immersed in the slurry. Through an adhesive covering the surface of the magnet base material, the diffusing material may be adhered to the magnet base material. In the diffusion step with use of the slurry or the paste, the amount of the binder used is more easily reduced in comparison with the case where the surface of the magnet base material is covered with an adhesive. In the case of using the slurry or the paste, a binder removal step is therefore not indispensable, and carbon derived from the binder hardly remains in a permanent magnet, so that degradation of magnetic properties of the permanent magnet caused by carbon is easily suppressed.

The temperature of the magnet base material in the diffusion step (diffusion temperature) may be equal to or higher than the melting point or the decomposition temperature of the first component, the second component and the third component each, and may be lower than the sintering temperature described above (or lower than the melting point of the magnet base material). The diffusion temperature may be adjusted depending on the composition, the melting point or the decomposition temperature of the first component, the second component and the third component each. For example, in the case where both of the first component and the second component are metals, the diffusion temperature may be 800° C. or more and 950° C. or less. In the case where both of the first component and the second component are hydrides also, the diffusion temperature may be 800° C. or more and 950° C. or less. In the diffusion step, the temperature of the magnet base material may be gradually raised from a temperature lower than the diffusion temperature to the diffusion temperature. For example, in a lower temperature region of about 600° C., Nd as a liquid phase (Nd-rich phase) easily seeps from the main phase grains of the magnet base material to the grain boundaries. In a temperature region of about 800° C., melting of the hydride of Dy easily proceeds. The time for maintaining the temperature of the magnet base material at the diffusion temperature (diffusion time) may be, for example, 1 hour or more and 50 hours or less. The atmosphere of the magnet base material in the diffusion step may be a non-oxidizing atmosphere. The non-oxidizing atmosphere may be, for example, a rare gas such as argon.

The total mass of Tb, Dy, Nd, Pr and Cu in the diffusing material may be expressed as $M_{ELEMENTS}$. The total mass of Tb and Dy in the diffusing material relative to $M_{ELEMENTS}$ may be 55% by mass or more and 85% by mass or less, 55% by mass or more and 80% by mass or less, or 59% by mass or more and 75% by mass or less. The total mass of Tb and Dy may be paraphrased as the total mass of RH in the diffusing material. In the case where the total mass of RH is 55% by mass or more, the total amount of the diffusing material required for increasing the coercivity of a permanent magnet is easily reduced. In the case where the total mass of RH is 85% by mass or less, reduction in the residual magnetic flux density of a permanent magnet is easily suppressed, and the manufacturing cost of a permanent magnet is reduced.

The total mass of Nd and Pr in the diffusing material relative to $M_{ELEMENTS}$ may be 10% by mass or more and 37% by mass or less, 15% by mass or more and 37% by mass or less, or 15% by mass or more and 32% by mass or less. The total mass of Nd and Pr may be paraphrased as the total mass of RL in the diffusing material. In the case where the total mass of RL is 10% by mass or more, an ample liquid phase of RL is easily present in the grain boundaries in the diffusion step, so that the diffusion of RH into the two-grain boundaries through the liquid phase of RL is easily facilitated. In the case where the total mass of RL is 37% by mass or less, the first component (RH) is not excessively diluted with the second component (RL), so that the coercivity of a permanent magnet is easily increased.

The Cu content in the diffusing material relative to $M_{ELEMENTS}$ may be 4% by mass or more and 30% by mass or less, 8% by mass or more and 25% by mass or less, or 8% by mass or more and 20% by mass or less. In the case where the Cu content is 4% by mass or more, RH diffuses easily into the two-grain boundaries and the vicinity of the surface of the main phase grains, and the diffusion of RH into the internal part of the main phase grains is easily suppressed. In the case where the Cu content is 30% by mass or less, reduction in the coercivity and the residual magnetic flux density of a permanent magnet is easily suppressed. In the case where the magnet base material comprises Cu, Cu derived from the magnet base material may exhibit the same effect as Cu derived from the diffusing material. However, it is difficult to obtain the same effect as Cu derived from the diffusing material by Cu derived from the magnet base material only.

The particle size of each of the first component, the second component and the third component may be in a range of 0.3 μm or more and 32 μm or less, or 0.3 μm or more and 90 μm or less. The particle size of each of the first component, the second component and the third component may be paraphrased as the particle size of the diffusing material. As the particle size of the diffusing material increases, oxygen contained in the diffusing material decreases, so that the diffusion of RH, RL and Cu is hardly blocked by oxygen. As a result, the coercivity of a permanent magnet is easily increased. As the particle size of the diffusing material decreases, the time required for melting the first component, the second component and the third component each is shortened, so that RH, RL and Cu each easily diffuse into the internal part of the magnet base material. As a result, the coercivity of a permanent magnet is easily increased. Also, as the particle size of the diffusing material decreases, the diffusing material adheres easily to the surface of the magnetic base material evenly, so that RH, RL and Cu each diffuse easily into the internal part of the magnet base material evenly. As a result, the variation of the coercivity of a permanent magnet is suppressed and the squareness ratio easily approaches 1.0.

The mass of the magnet base material may be expressed as 100 parts by mass, and the total mass of Tb and Dy in the diffusing material may be 0.0 part by mass or more and 2.0 parts by mass or less relative to 100 parts by mass of the magnet base material. In the case where the total mass of Tb and Dy relative to the magnet base material is in the range described above, the total content of Tb and Dy in the whole of a permanent magnet is easily controlled to 0.20% by mass or more and 2.00% by mass or less, and the inequalities 1 and 2 are easily satisfied.

The total content of Nd and Pr in the magnet base material may be 23.0% by mass or more and 32.0% by mass or less. The total content of Tb and Dy in the magnet base material may be 0.0% by mass or more and 5.0% by mass or less. The total content of Fe and Co in the magnet base material may be 63% by mass or more and 72% by mass or less. The content of Cu in the magnet base material may be 0.04% by mass or more and 0.5% by mass or less. In the case where the magnet base material has the composition described above, the inequalities 1 and 2 are easily satisfied.

[Heat Treatment Step]

After being subjected to the diffusion step, the magnetic base material may be used as a finished product of a permanent magnet. Alternatively, after the diffusion step, a heat treatment step may be performed. In the heat treatment step, the magnetic base material may be heated at 450° C. or more and 600° C. or less. In the heat treatment step, the magnetic base material may be heated at the temperature for 1 hour or more and 10 hours or less. By the heat treatment step, the magnetic properties (in particular, coercivity) of a permanent magnet are easily improved.

The dimensions and the shape of the magnet base material subjected to the diffusion step or the heat treatment step may be adjusted by processing such as cutting and polishing.

A permanent magnet in the present embodiment is obtained by the method described above.

The present invention is not limited to the embodiments described above. For example, the magnet base material for use in the diffusion step may be a hot-deformed magnet. A hot-deform magnet may be manufactured by the following manufacturing method.

The raw material of a hot-deform magnet may be an alloy which is the same as the alloy for use in making a sintered body. The alloy is melted and quenched to obtain a ribbon of alloy. The ribbon is pulverized to obtain a raw material powder in a flake form. The raw material powder is cold pressed (forming at room temperature) to obtain a green compact. After preheating of the green compact, the green compact is hot pressed to obtain an isotropic magnet. The isotropic magnet is subjected to hot plastic working to obtain an anisotropic magnet. The anisotropic magnet is subjected to an aging treatment to obtain a magnet base material made of hot-deformed magnet. The magnet base material made of hot-deformed magnet includes many main phase grains bounded to each other in the same manner as the sintered body described above.

EXAMPLES

Although the present invention will be described still more specifically with reference to Examples and Comparative Examples in the following, the present invention is not limited to the following Examples.

<Manufacturing of Magnet Base Material 1>

A raw material alloy 1 was made from raw material metals by strip casting. The composition of the raw material alloy 1 was adjusted by weighing raw material metals, such that the composition of the raw material alloy 1 after sintering coincided with the composition of a magnet base material 1 in the following Table 1.

After hydrogen was stored into the raw material alloy 1 at room temperature, the raw material alloy 1 was heated at 600° C. for 1 hour in an Ar atmosphere for dehydrogenation, so that a raw material alloy powder was obtained. In other words, hydrogen pulverization treatment was performed.

As pulverization aid, zinc stearate was added to the raw material alloy powder, and they were mixed by a cone mixer. The content of zinc stearate in the raw material alloy powder was adjusted to 0.1% by mass. In the subsequent fine pulverization step, the average particle size of the raw material alloy powder was adjusted to 4.0 μm by using a jet mill. In the subsequent molding step, the raw material alloy powder was packed in a mold. While applying a magnetic field of 1200 kA/m to the raw material powder in the mold, the raw material powder was pressurized at 120 MPa to obtain a green compact.

In a sintering step, the green compact was heated at 1060° C. for 4 hours in vacuum and then quenched to obtain a sintered body.

As an aging step, a first aging and a second aging subsequent to the first aging were performed. In both of the first aging and the second aging, the sintered body was heated in an Ar atmosphere. In the first aging, the sintered body was heated at 850° C. for 1 hour. In the second aging, the sintered body was heated at 540° C. for 2 hours.

By the method described above, a magnet base material 1 was obtained. The composition of the magnet base material 1 is shown in the following Table 1.

<Manufacturing of Magnet Base Material 2>

A raw material alloy 2 was made from raw material metals by strip casting. The composition of the raw material alloy 2 was adjusted by weighing raw material metals, such that the composition of the raw material alloy 2 after sintering coincided with the composition of a magnet base material 2 in the following table.

The magnet base material 2 was made from the raw material alloy 2. Except for the composition of the raw material alloy, the method for manufacturing the magnet base material 2 was the same as the method for manufacturing the magnet base material 1. The composition of the magnet base material 2 is shown in the following Table 1.

<Manufacturing of Magnet Base Material 3>

A raw material alloy 3 was made from raw material metals by strip casting. The composition of the raw material alloy 3 was adjusted by weighing raw material metals, such that the composition of the raw material alloy 3 after sintering coincided with the composition of a magnet base material 3 in the following Table.

The magnet base material 3 was made from the raw material alloy 3. Except for the composition of the raw material alloy, the method for manufacturing the magnet base material 3 was the same as the method for manufacturing the magnet base material 1. The composition of the magnet base material 3 is shown in the following Table 1.

TABLE 1

| | Content of each element in magnet base material (% by mass) | | | | | | | | | |
|---|---|---|---|---|---|---|---|---|---|---|
| | Nd | Pr | Dy | Co | Cu | Zr | Al | Ga | B | Fe |
| Magnet base material 1 | 23.00 | 7.00 | 0.00 | 2.00 | 0.30 | 0.20 | 0.20 | 0.20 | 0.90 | Bal. (balance) |
| Magnet base material 2 | 28.00 | 0.50 | 1.50 | 0.50 | 0.20 | 0.20 | 0.20 | 0.10 | 0.95 | Bal. (balance) |
| Magnet base material 3 | 20.00 | 6.00 | 4.00 | 0.50 | 0.20 | 0.20 | 0.20 | 0.15 | 0.95 | Bal. (balance) |

<Manufacturing of Diffusing Material A>

As raw material of a diffusing material A, a simple substance of Tb (single metal substance) was used. The purity of the simple substance of Tb was 99.9% by mass.

After hydrogen was stored in the simple substance of Tb at room temperature, the simple substance of Tb was heated at 600° C. for 1 hour in an Ar atmosphere for dehydrogenation, so that a powder consisting of hydride of Tb was obtained. In other words, hydrogen pulverization treatment was performed.

As pulverization aid, zinc stearate was added to the powder of hydride of Tb, and they were mixed by a cone mixer. The content of zinc stearate in the powder of hydride of Tb was adjusted to 0.1% by mass. In the subsequent fine pulverization step, the powder of hydride of Tb was further pulverized under a non-oxidizing atmosphere with an oxygen content of 3000 ppm. The fine pulverization step was performed by using a jet mill. The average particle size of the powder consisting of hydride of Tb was adjusted to about 10.0 μm.

By the method described above, the powder (first component) consisting of hydride of Tb ($TbH_2$) was obtained. The powder consisting of hydride of Tb, an alcohol (solvent) and an acrylic resin (binder) were kneaded to manufacture a diffusing material A in a paste form. The mass ratio of the first component in the diffusing material A was 75.0 parts by mass. The mass ratio of the solvent in the diffusing material A was 23.0 parts by mass. The mass ratio of the binder in the diffusing material A was 2.0 parts by mass.

<Manufacturing of Diffusing Material B>

A powder (second component) consisting of hydride of Nd ($NdH_2$) was manufactured from a simple substance (single metal substance) of Nd. The purity of the simple substance of Nd was 99.9% by mass. The average particle size of the powder consisting of hydride of Nd was about 10.0 μm. The method for manufacturing the powder consisting of hydride of Nd was the same as the method for manufacturing the powder consisting of hydride of Tb, except that the simple substance of Nd was used as raw material.

The powder consisting of hydride of Tb (first component), the powder consisting of hydride of Nd (second component), a powder consisting of simple substance (single metal substance) of Cu (third component), an alcohol (solvent), and an acrylic resin (binder) were kneaded to manufacture a diffusing material B in a paste form. The mass ratio of the first component in the diffusing material B was 46.8 parts by mass. The mass ratio of the second component in the diffusing material B was 17.0 parts by mass. The mass ratio of the third component in the diffusing material B was 11.2 parts by mass. The mass ratio of the solvent in the diffusing material B was 23.0 parts by mass. The mass ratio of the binder in the diffusing material B was 2.0 parts by mass.

<Manufacturing of Sample No. 1>

By mechanical processing of the magnet base material 1, the dimensions of the magnet base material 1 was adjusted to a length of 14 mm, a width of 10 mm, and a thickness of 4.2 mm. After adjustment of dimensions of the magnet base material 1, the magnet base material 1 was subjected to an etching treatment. In the etching treatment, all surfaces of the magnet base material 1 was washed with an aqueous solution of nitric acid. Subsequently, all surfaces of the magnet base material 1 was washed with pure water. After washing, the magnet base material 1 was dried. The concentration of the aqueous solution of nitric acid was 0.3% by mass. After the etching treatment, the following diffusion step was performed.

In the diffusion step, the diffusing material B was applied to all surfaces of the magnet base material 1. The mass of the diffusing material B applied to the magnet base material 1 was adjusted such that the mass of Tb contained in the diffusing material B became 0.5 parts by mass relative to 100 parts by mass of the magnet base material 1. The magnet base material 1 coated with the diffusing material B was placed in an oven and heated at 160° C., so that the solvent in the diffusing material B was removed. After removal of the solvent, the magnet base material 1 coated with the diffusing material B was heated at 900° C. for 6 hours in Ar gas.

In a heat treatment step subsequent to the diffusion step, the magnet base material 1 was heated at 540° C. for 2 hours in Ar gas.

By the method described above, a permanent magnet of Sample No. 1 was manufactured. The content of each of the elements in the whole of the permanent magnet of Sample No. 1 is shown in the following Table 2.

<Manufacturing of Sample No. 2>

In the diffusion step of Sample No. 2, the diffusing material B was applied to all surfaces of the magnet base material 2. A permanent magnet of Sample No. 2 was manufactured in the same manner as in Sample No. 1 except for the composition of the magnet base material. The content of each of the elements in the whole of the permanent magnet of Sample No. 2 is shown in the following Table 2.

<Manufacturing of Sample No. 3>

In the diffusion step of Sample No. 3, the diffusing material B was applied to all surfaces of the magnet base material 3. A permanent magnet of Sample No. 3 was manufactured in the same manner as in Sample No. 1 except for the composition of the magnet base material. The content of each of the elements in the whole of the permanent magnet of Sample No. 3 is shown in the following Table 2.

<Manufacturing of Sample No. 4>

In the diffusion step of Sample No. 4, the diffusing material A was applied to all surfaces of the magnet base material 1. A permanent magnet of Sample No. 4 was manufactured in the same manner as in Sample No. 1 except for the composition of the diffusing material. The content of each of the elements in the whole of the permanent magnet of Sample No. 4 is shown in the following Table 2.

<Manufacturing of Sample No. 5>

In the diffusion step of Sample No. 5, the diffusing material A was applied to all surfaces of the magnet base material 2. A permanent magnet of Sample No. 5 was manufactured in the same manner as in Sample No. 1 except for each of the compositions of the magnet base material and the diffusing material. The content of each of the elements in the whole of the permanent magnet of Sample No. 5 is shown in the following Table 2.

<Manufacturing of Sample No. 6>

In the diffusion step of Sample No. 6, the diffusing material A was applied to all surfaces of the magnet base material 3. A permanent magnet of Sample No. 6 was manufactured in the same manner as in Sample No. 1 except for each of the compositions of the magnet base material and the diffusing material. The content of each of the elements in the whole of the permanent magnet of Sample No. 6 is shown in the following Table 2.

TABLE 2

| | | Content of each element in the whole of permanent magnet (% by mass) | | | | | | | | | | | | | |
|---|---|---|---|---|---|---|---|---|---|---|---|---|---|---|---|
| | | Nd | Pr | Dy | Tb | Fe | Co | Cu | Zr | Al | Ga | O | C | N | B |
| Sample No. 1 | Example | 23.00 | 7.00 | 0.00 | 0.35 | 65.60 | 2.00 | 0.30 | 0.20 | 0.20 | 0.20 | 0.10 | 0.10 | 0.05 | 0.90 |
| Sample No. 2 | Example | 28.00 | 0.50 | 1.50 | 0.30 | 67.30 | 0.50 | 0.20 | 0.20 | 0.20 | 0.10 | 0.10 | 0.10 | 0.05 | 0.95 |
| Sample No. 3 | Example | 20.00 | 6.00 | 4.00 | 0.35 | 67.20 | 0.50 | 0.20 | 0.20 | 0.20 | 0.15 | 0.10 | 0.10 | 0.05 | 0.95 |
| Sample No. 4 | Example | 23.00 | 7.00 | 0.00 | 0.26 | 65.79 | 2.00 | 0.20 | 0.20 | 0.20 | 0.20 | 0.10 | 0.10 | 0.05 | 0.90 |
| Sample No. 5 | Comparative Example | 28.00 | 0.50 | 1.50 | 0.17 | 67.56 | 0.50 | 0.07 | 0.20 | 0.20 | 0.10 | 0.10 | 0.10 | 0.05 | 0.95 |
| Sample No. 6 | Comparative Example | 20.00 | 6.00 | 4.00 | 0.18 | 67.50 | 0.50 | 0.07 | 0.20 | 0.20 | 0.15 | 0.10 | 0.10 | 0.05 | 0.95 |

[Evaluation of Magnetic Properties]

By cutting the surface of each permanent magnet, a portion having a depth of 0.1 mm or less from the surface was removed. Subsequently, the residual magnetic flux density Br and the coercivity HcJ of each permanent magnet were measured by a BH tracer. Br (unit: mT) was measured at room temperature (RT). HcJ (unit: kA/m) was measured at 160° C.

A permanent magnet is used in a motor or a generator installed on an electric vehicle or a hybrid vehicle. With the operation of the motor or the generator, the temperature of the permanent magnet increases. As the temperature of the permanent magnet increases, the coercivity of the permanent magnet decreases. Due to restriction of design and manufacturing cost of a vehicle, a cooling device for the permanent magnet is not necessarily installed on the vehicle. The permanent magnet is therefore required for having a sufficient coercivity even at high temperature. The coercivity at 160° C. is an index for evaluating magnetic properties of the permanent magnet at high temperature.

PI (potential index) of each permanent magnet defined by the following numerical expression was calculated. Br in the following numerical expression is a measurement value of residual magnetic flux density at room temperature. HcJ in the following numerical expression is a measurement value of coercivity at 160° C. The residual magnetic flux density and the coercivity are in a trade-off relation. In other words, as the residual magnetic flux density increases, the coercivity tends to decrease, and as the coercivity increases, the residual magnetic flux density tends to decrease. PI calculated from Br and HcJ is an index for evaluating the residual magnetic flux density and the coercivity in a comprehensive way. It is preferable that PI be 1500 or more.

$$PI=Br+25\times HcJ\times 4\pi/2000$$

Br, HcJ, and PI of Sample Nos. 1 to 6 each are shown in the following Table 3.

TABLE 3

| | | Br at RT (mT) | HcJ at 160° C. (kA/m) | Potential Index (PI) Br + 25 × HcJ × 4π/2000 |
|---|---|---|---|---|
| Sample No. 1 | Example | 1458 | 680 | 1565 |
| Sample No. 2 | Example | 1389 | 744 | 1506 |
| Sample No. 3 | Example | 1355 | 1000 | 1512 |

TABLE 3-continued

| | | Br at RT (mT) | HcJ at 160° C. (kA/m) | Potential Index (PI) Br + 25 × HcJ × 4π/2000 |
|---|---|---|---|---|
| Sample No. 4 | Example | 1460 | 620 | 1557 |
| Sample No. 5 | Comparative Example | 1389 | 637 | 1489 |
| Sample No. 6 | Comparative Example | 1357 | 832 | 1488 |

Any PI of Sample Nos. 1 to 4 was 1500 or more. Any PI of Samples Nos. 1 to 4 was larger than PI of Sample Nos. 5 and 6.

Sample Nos. 1 and 4 having a common magnet base material composition were compared. Br of Sample No. 1 was approximately equal to Br of Sample No. 4. HcJ of Sample No. 1 was remarkably larger than HcJ of Sample No. 4. PI of Sample No. 1 was larger than PI of Sample No. 4.

Sample Nos. 2 and 5 having a common magnet base material composition were compared. Br of Sample No. 2 was approximately equal to Br of Sample No. 5. HcJ of Sample No. 2 was remarkably larger than HcJ of Sample No. 5. PI of Sample No. 2 was larger than PI of Sample No. 5.

Sample Nos. 3 and 6 having a common magnet base material composition were compared. Br of Sample No. 3 was approximately equal to Br of Sample No. 6. HcJ of Sample No. 3 was remarkably larger than HcJ of Sample No. 6. PI of Sample No. 3 was larger than PI of Sample No. 6.

[Analysis of Composition of Grain Boundary Triple Point]

The permanent magnet of each of Sample Nos. 1 to 6 was cut in the direction perpendicular to the surface thereof. The backscattered electron image of a cross-section of each permanent magnet was photographed by a scanning electron microscope (SEM).

Figure 3:
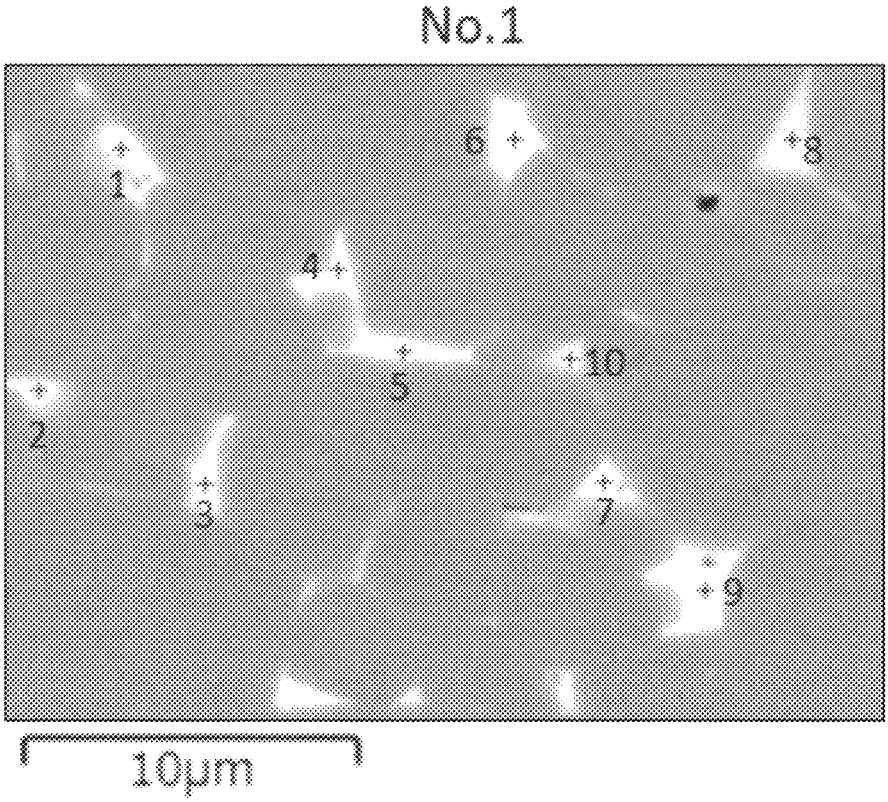
FIG. 3 is a backscattered electron image showing a cross-section of sample No. 1 of R-T-B permanent magnet.

A backscattered electron image of a cross-section of Sample No. 1 is shown in FIG. 3. A dark portion (gray portion) in the backscattered electron image corresponds to the cross-section of a main phase grain, and a bright portion (white portion) in the backscattered electron image corresponds to the cross-section of a grain boundary. The permanent magnet of Sample No. 1 comprised a plurality of main phase grains and grain boundary triple points each surrounded by three or more main phase grains. The content of each element in measurement points 1 to 10 in FIG. 3 was measured by an energy dispersive X-ray spectrometer (EDS apparatus). Any of the measurement points 1 to 10 was a grain boundary triple point. The content of each element in each measurement point (unit: atom %) is shown in the following Table 4.

Fe in (Fe+Co)/(Nd+Pr) described in Tables 4 to 9 is an Fe content in each measurement point. Co in (Fe+Co)/(Nd+Pr) is a Co content in each measurement point. Nd in (Fe+Co)/(Nd+Pr) is an Nd content in each measurement point. Pr in (Fe+Co)/(Nd+Pr) is a Pr content in each measurement point. Cu in Cu/Tb and Cu/(Tb+Dy) described in Tables 4 to 9 is a Cu content in each measurement point. Tb in Cu/Tb and Cu/(Tb+Dy) is a Tb content in each measurement point. Dy in Cu/(Tb+Dy) is a Dy content in each measurement point.

The average content of each element in measurement points 1 to 10 of Sample No. 1 is shown in the following Table 10. From the average content of each element in the measurement points 1 to 10, ([Fe]+[Co])/([Nd]+[Pr]), [Cu]/[Tb] and [Cu]/([Tb]+[Dy]) were calculated. These values are also shown in the following Table 10.

Figure 4:
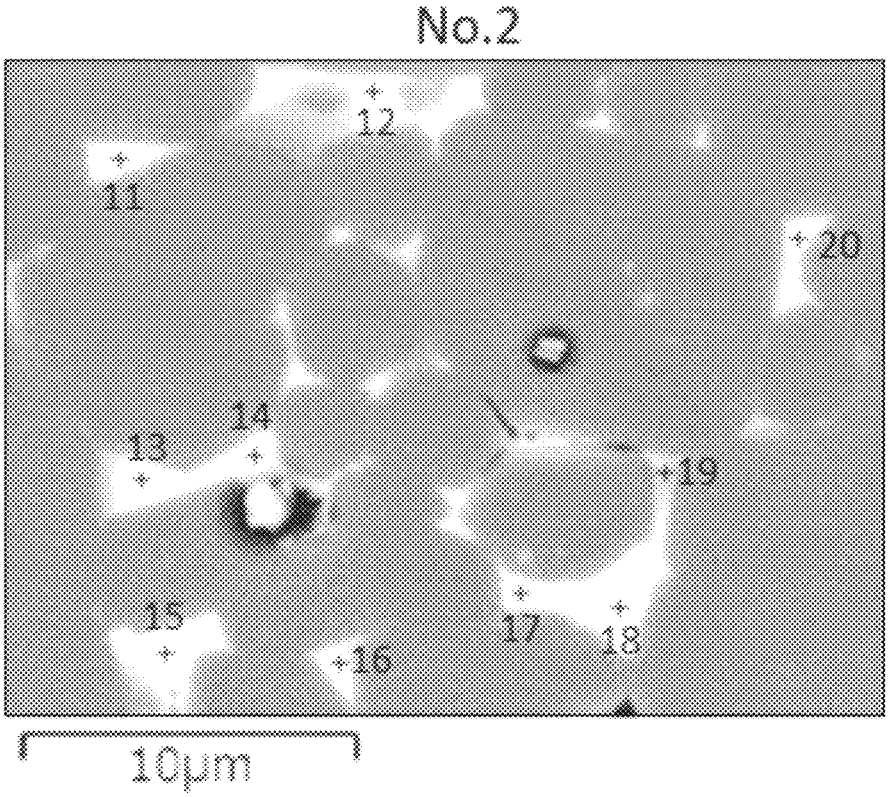
FIG. 4 is a backscattered electron image showing a cross-section of sample No. 2 of R-T-B permanent magnet.

A backscattered electron image of a cross-section of Sample No. 2 is shown in FIG. 4. The permanent magnet of Sample 2 comprised a plurality of main phase grains and grain boundary triple points each surrounded by three or more main phase grains. The content of each element in measurement points 11 to 20 in FIG. 4 was measured by an EDS apparatus. Any of the measurement points 11 to 20 was a grain boundary triple point. The content of each element in each measurement point (unit: atom %) is shown in the following Table 5. The average content of each element in measurement points 11 to 20 is shown in the following Table 10. From the average content of each element in measurement points 11 to 20, ([Fe]+[Co])/([Nd]+[Pr]), [Cu]/[Tb] and [Cu]/([Tb]+[Dy]) were calculated. These values are also shown in the following Table 10.

Figure 5:
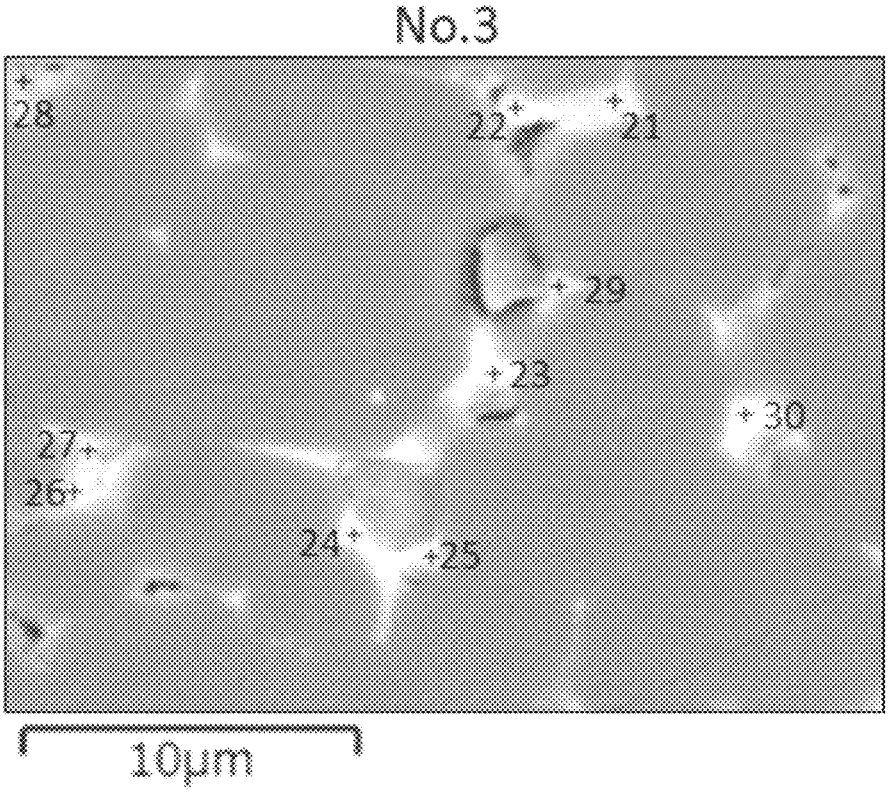
FIG. 5 is a backscattered electron image showing a cross-section of sample No. 3 of R-T-B permanent magnet.

A backscattered electron image of a cross-section of Sample No. 3 is shown in FIG. 5. The permanent magnet of Sample 3 comprised a plurality of main phase grains and grain boundary triple points each surrounded by three or more main phase grains. The content of each element in measurement points 21 to 30 in FIG. 5 was measured by an EDS apparatus. Any of the measurement points 21 to 30 was a grain boundary triple point. The content of each element in each measurement (unit: atom %) is shown in the following Table 6. The average content of each element in measurement points 21 to 30 is shown in the following Table 10. From the average content of each element in measurement points 21 to 30, ([Fe]+[Co])/([Nd]+[Pr]), [Cu]/[Tb] and [Cu]/([Tb]+[Dy]) were calculated. These values are also shown in the following Table 10.

Figure 6:
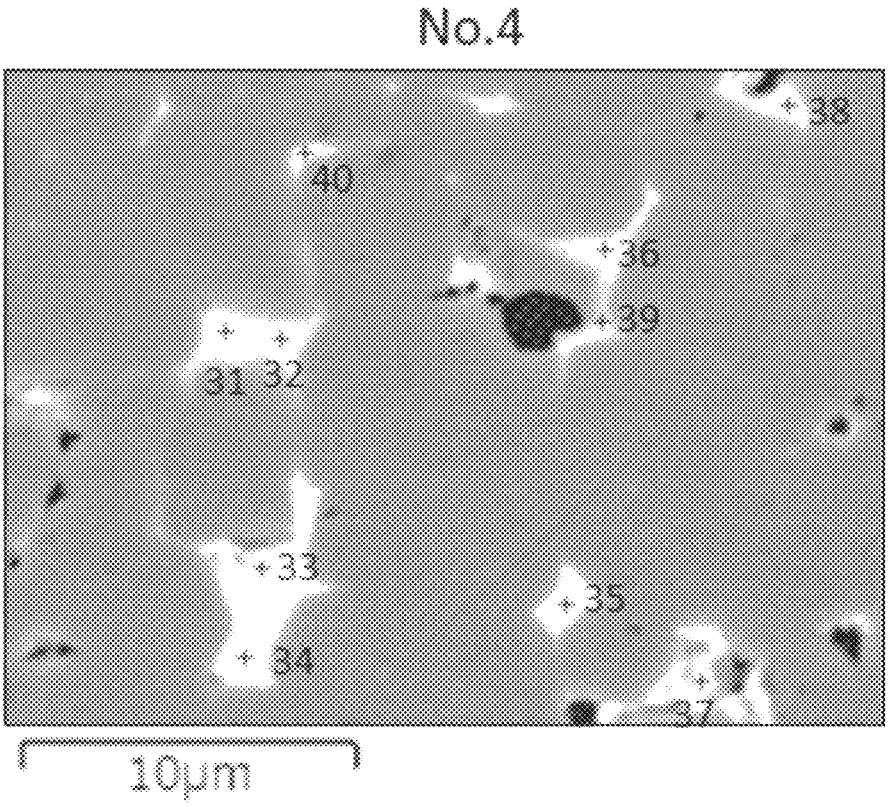
FIG. 6 is a backscattered electron image showing a cross-section of sample No. 4 of R-T-B permanent magnet.

A backscattered electron image of a cross-section of Sample No. 4 is shown in FIG. 6. The permanent magnet of Sample No. 4 comprised a plurality of main phase grains and grain boundary triple points each surrounded by three or more main phase grains. The content of each element in measurement points 31 to 40 in FIG. 6 was measured by an EDS apparatus. Any of the measurement points 31 to 40 was a grain boundary triple point. The content of each element in each measurement (unit: atom %) is shown in the following Table 7. The average content of each element in measurement points 31 to 40 is shown in the following Table 10. From the average content of each element in measurement points 31 to 40, ([Fe]+[Co])/([Nd]+[Pr]), [Cu]/[Tb] and [Cu]/([Tb]+[Dy]) were calculated. These values are also shown in the following Table 10.

Figure 7:
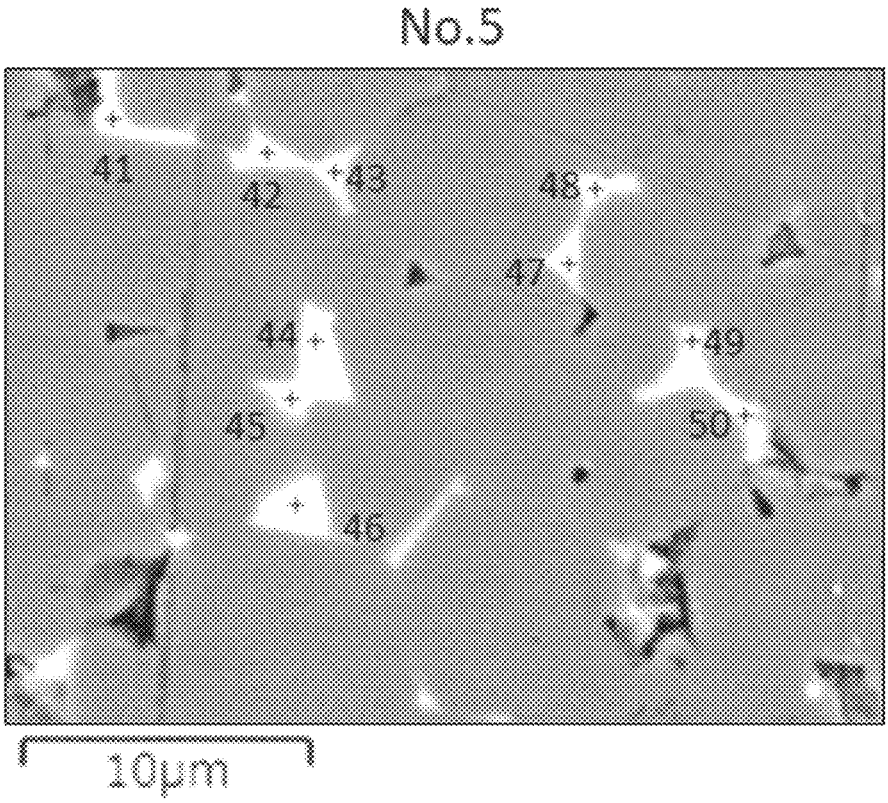
FIG. 7 is a backscattered electron image showing a cross-section of sample No. 5 of R-T-B permanent magnet.

A backscattered electron image of a cross-section of Sample No. 5 is shown in FIG. 7. The permanent magnet of Sample 5 comprised a plurality of main phase grains and grain boundary triple points each surrounded by three or more main phase grains. The content of each element in measurement points 41 to 50 in FIG. 7 was measured by an EDS apparatus. Any of the measurement points 41 to 50 was a grain boundary triple point. The content of each element in each measurement (unit: atom %) is shown in the following Table 8. The average content of each element in measurement points 41 to 50 is shown in the following Table 10. From the average content of each element in measurement points 41 to 50, ([Fe]+[Co])/([Nd]+[Pr]), [Cu]/[Tb] and [Cu]/([Tb]+[Dy]) were calculated. These values are also shown in the following Table 10.

Figure 8:
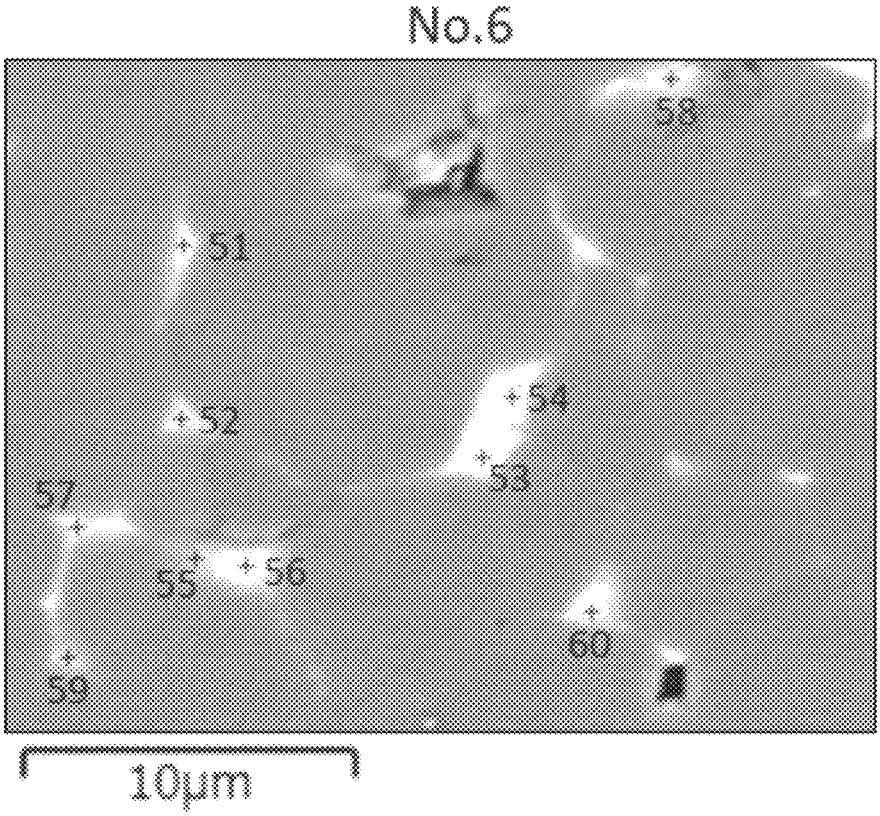
FIG. 8 is a backscattered electron image showing a cross-section of sample No. 6 of R-T-B permanent magnet.

A backscattered electron image of a cross-section of Sample No. 6 is shown in FIG. 8. The permanent magnet of Sample No. 6 comprised a plurality of main phase grains and grain boundary triple points each surrounded by three or more main phase grains. The content of each element in measurement points 51 to 60 in FIG. 8 was measured by an EDS apparatus. Any of the measurement points 51 to 60 was a grain boundary triple point. The content of each element in each measurement (unit: atom %) is shown in the following Table 9. The average content of each element in measurement points 51 to 60 is shown in the following Table 10. From the average content of each element in measurement points 51 to 60, ([Fe]+[Co])/([Nd]+[Pr]), [Cu]/[Tb] and [Cu]/([Tb]+[Dy]) were calculated. These values are also shown in the following Table 10.

TABLE 4

| | Measurement | Content of each element in grain boundary triple point (each measurement point) (atom %) | | | | | | | | | | | |
|---|---|---|---|---|---|---|---|---|---|---|---|---|---|
| | point | Nd | Pr | Dy | Tb | Fe | Co | Cu | Al | Ga | O | C | N |
| Sample | 1 | 22.1 | 7.5 | 0.0 | 1.1 | 34.1 | 2.5 | 0.1 | 0.7 | 0.1 | 9.1 | 16.5 | 6.3 |
| No. 1 | 2 | 15.3 | 5.2 | 0.0 | 1.9 | 53.4 | 1.1 | 3.1 | 0.5 | 0.2 | 3.9 | 15.1 | 0.3 |
| | 3 | 15.6 | 5.3 | 0.0 | 1.5 | 46.2 | 1.2 | 5.4 | 0.8 | 0.1 | 4.5 | 19.0 | 0.5 |
| | 4 | 22.5 | 7.7 | 0.0 | 3.0 | 36.2 | 1.5 | 5.3 | 0.4 | 0.1 | 5.4 | 17.0 | 1.0 |

TABLE 4-continued

| Measurement point | Content of each element in grain boundary triple point (each measurement point) (atom %) | | | | | | | | | | | |
|---|---|---|---|---|---|---|---|---|---|---|---|---|
| | Nd | Pr | Dy | Tb | Fe | Co | Cu | Al | Ga | O | C | N |
| 5 | 16.6 | 5.7 | 0.0 | 2.3 | 47.1 | 2.4 | 3.2 | 0.7 | 0.1 | 4.1 | 16.6 | 1.2 |
| 6 | 23.5 | 8.0 | 0.0 | 2.6 | 28.9 | 3.5 | 5.5 | 1.2 | 0.1 | 5.0 | 20.4 | 1.2 |
| 7 | 12.5 | 4.3 | 0.0 | 1.3 | 59.9 | 3.0 | 0.5 | 2.4 | 0.1 | 4.1 | 11.2 | 0.7 |
| 8 | 12.9 | 4.4 | 0.0 | 1.2 | 58.4 | 1.1 | 1.9 | 0.3 | 0.2 | 4.0 | 15.1 | 0.6 |
| 9 | 15.2 | 5.2 | 0.0 | 1.5 | 51.7 | 1.6 | 3.0 | 0.6 | 0.0 | 5.9 | 15.3 | 0.0 |
| 10 | 12.2 | 4.2 | 0.0 | 1.0 | 53.5 | 1.0 | 8.8 | 0.0 | 0.1 | 3.5 | 15.6 | 0.1 |
| Average | 16.9 | 5.8 | 0.0 | 1.8 | 46.9 | 1.9 | 3.7 | 0.7 | 0.1 | 4.9 | 16.2 | 1.2 |

TABLE 5

| | Measurement point | Content of each element in grain boundary triple point (each measurement point) (atom %) | | | | | | | | | | | |
|---|---|---|---|---|---|---|---|---|---|---|---|---|---|
| | | Nd | Pr | Dy | Tb | Fe | Co | Cu | A1 | Ga | O | C | N |
| Sample No. 2 | 11 | 36.1 | 0.4 | 0.3 | 1.2 | 30.9 | 0.4 | 0.6 | 0.8 | 0.0 | 4.8 | 24.1 | 0.2 |
| | 12 | 16.5 | 0.4 | 0.2 | 0.4 | 61.9 | 0.4 | 1.9 | 1.1 | 0.0 | 3.3 | 13.5 | 0.3 |
| | 13 | 25.2 | 0.5 | 0.3 | 1.0 | 50.5 | 0.7 | 0.5 | 0.9 | 0.0 | 4.3 | 16.2 | 0.0 |
| | 14 | 10.9 | 0.5 | 0.2 | 0.0 | 75.5 | 0.7 | 0.2 | 0.6 | 0.0 | 2.6 | 8.7 | 0.0 |
| | 15 | 11.5 | 0.1 | 0.4 | 0.2 | 72.8 | 0.1 | 0.3 | 0.5 | 0.1 | 3.8 | 10.3 | 0.0 |
| | 16 | 10.9 | 0.2 | 0.2 | 0.2 | 71.8 | 0.1 | 1.6 | 0.8 | 0.1 | 2.5 | 11.4 | 0.0 |
| | 17 | 10.8 | 0.4 | 0.4 | 0.1 | 74.5 | 0.2 | 0.3 | 0.6 | 0.1 | 2.1 | 10.0 | 0.6 |
| | 18 | 11.1 | 0.1 | 0.3 | 0.4 | 74.0 | 0.5 | 2.3 | 0.5 | 0.0 | 2.2 | 8.7 | 0.0 |
| | 19 | 16.6 | 0.5 | 1.1 | 0.3 | 66.6 | 0.3 | 1.8 | 0.3 | 0.1 | 2.4 | 9.8 | 0.0 |
| | 20 | 11.8 | 0.2 | 0.6 | 0.4 | 68.2 | 0.4 | 1.1 | 0.7 | 0.0 | 3.6 | 9.6 | 3.3 |
| | Average | 16.1 | 0.3 | 0.4 | 0.4 | 64.7 | 0.4 | 1.1 | 0.7 | 0.0 | 3.2 | 12.2 | 0.4 |

TABLE 6

| | Measurement point | Content of each element in grain boundary triple point (each measurement point) (atom %) | | | | | | | | | | | |
|---|---|---|---|---|---|---|---|---|---|---|---|---|---|
| | | Nd | Pr | Dy | Tb | Fe | Co | Cu | Al | Ga | O | C | N |
| Sample No. 3 | 21 | 16.7 | 5.1 | 1.2 | 1.6 | 45.8 | 1.1 | 3.5 | 3.1 | 0.1 | 5.9 | 15.7 | 0.0 |
| | 22 | 14.5 | 4.5 | 0.7 | 0.8 | 45.9 | 0.9 | 2.6 | 1.9 | 0.0 | 5.5 | 22.2 | 0.4 |
| | 23 | 17.6 | 5.4 | 0.7 | 1.3 | 38.5 | 0.1 | 0.4 | 0.7 | 0.1 | 4.7 | 30.4 | 0.0 |
| | 24 | 15.4 | 4.7 | 1.4 | 1.0 | 40.6 | 0.2 | 0.5 | 0.7 | 0.1 | 4.1 | 31.3 | 0.0 |
| | 25 | 12.8 | 3.9 | 2.4 | 0.6 | 46.5 | 0.2 | 1.4 | 1.0 | 0.2 | 4.7 | 26.3 | 0.0 |
| | 26 | 15.2 | 4.7 | 2.1 | 1.1 | 39.8 | 0.2 | 1.1 | 0.7 | 0.2 | 4.5 | 30.3 | 0.0 |
| | 27 | 11.8 | 3.6 | 2.0 | 1.0 | 51.2 | 0.3 | 6.4 | 0.8 | 0.2 | 5.6 | 15.9 | 1.2 |
| | 28 | 16.9 | 5.2 | 1.4 | 1.2 | 39.4 | 0.7 | 11.6 | 0.4 | 0.2 | 4.8 | 16.2 | 1.9 |
| | 29 | 16.4 | 5.0 | 1.8 | 0.8 | 34.5 | 0.6 | 1.4 | 0.7 | 0.2 | 6.0 | 32.4 | 0.0 |
| | 30 | 16.5 | 5.1 | 0.4 | 1.5 | 38.6 | 0.3 | 0.7 | 1.0 | 0.0 | 5.6 | 30.3 | 0.0 |
| | Average | 15.4 | 4.7 | 1.4 | 1.1 | 42.1 | 0.5 | 3.0 | 1.1 | 0.1 | 5.1 | 25.1 | 0.4 |

TABLE 7

| | Measurement point | Content of each element in grain boundary triple point (each measurement point) (atom %) | | | | | | | | | | | |
|---|---|---|---|---|---|---|---|---|---|---|---|---|---|
| | | Nd | Pr | Dy | Tb | Fe | Co | Cu | Al | Ga | O | C | N |
| Sample No. 4 | 31 | 12.9 | 4.4 | 0.0 | 1.5 | 58.3 | 1.2 | 0.6 | 1.0 | 0.1 | 4.9 | 14.7 | 0.5 |
| | 32 | 11.3 | 3.4 | 0.0 | 1.1 | 59.0 | 1.2 | 3.2 | 1.1 | 0.1 | 5.2 | 13.8 | 0.6 |
| | 33 | 20.4 | 7.0 | 0.0 | 2.7 | 16.7 | 2.3 | 3.8 | 0.0 | 0.1 | 24.2 | 18.6 | 4.3 |
| | 34 | 20.3 | 5.9 | 0.0 | 2.8 | 25.6 | 0.9 | 3.8 | 0.1 | 0.2 | 18.8 | 20.0 | 1.5 |
| | 35 | 19.1 | 6.5 | 0.0 | 3.0 | 45.2 | 1.3 | 3.8 | 0.2 | 0.1 | 4.3 | 16.5 | 0.0 |
| | 36 | 9.8 | 2.7 | 0.0 | 0.9 | 59.5 | 1.2 | 6.6 | 0.7 | 0.1 | 4.5 | 13.6 | 0.3 |
| | 37 | 12.2 | 5.0 | 0.0 | 0.8 | 35.9 | 2.7 | 3.6 | 0.2 | 0.1 | 24.9 | 13.1 | 1.5 |
| | 38 | 15.4 | 5.2 | 0.0 | 1.1 | 24.7 | 2.5 | 0.5 | 0.4 | 0.2 | 27.8 | 19.9 | 2.4 |
| | 39 | 14.3 | 4.6 | 0.0 | 0.6 | 32.3 | 0.9 | 4.4 | 0.5 | 0.1 | 23.4 | 17.9 | 0.9 |

TABLE 7-continued

| | Measurement point | Content of each element in grain boundary triple point (each measurement point) (atom %) | | | | | | | | | | | |
|---|---|---|---|---|---|---|---|---|---|---|---|---|---|
| | | Nd | Pr | Dy | Tb | Fe | Co | Cu | Al | Ga | O | C | N |
| | 40 | 16.8 | 5.0 | 0.0 | 2.2 | 39.0 | 1.0 | 4.9 | 0.1 | 0.1 | 15.2 | 15.0 | 0.7 |
| | Average | 15.2 | 5.0 | 0.0 | 1.7 | 39.6 | 1.5 | 3.5 | 0.5 | 0.1 | 15.3 | 16.3 | 1.3 |

TABLE 8

| | Measurement point | Content of each element in grain boundary triple point (each measurement point) (atom %) | | | | | | | | | | | |
|---|---|---|---|---|---|---|---|---|---|---|---|---|---|
| | | Nd | Pr | Dy | Tb | Fe | Co | Cu | Al | Ga | O | C | N |
| Sample No. 5 | 41 | 26.7 | 0.3 | 0.4 | 1.0 | 34.7 | 0.2 | 0.2 | 0.7 | 0.0 | 4.4 | 31.3 | 0.0 |
| | 42 | 30.7 | 0.3 | 0.5 | 1.0 | 31.6 | 0.2 | 0.0 | 0.7 | 0.0 | 5.2 | 29.7 | 0.0 |
| | 43 | 34.7 | 0.5 | 0.9 | 1.2 | 21.9 | 0.2 | 0.3 | 0.4 | 0.0 | 5.3 | 34.7 | 0.0 |
| | 44 | 30.7 | 0.3 | 0.5 | 1.1 | 36.8 | 0.2 | 0.0 | 1.0 | 0.0 | 3.3 | 26.0 | 0.0 |
| | 45 | 32.0 | 0.4 | 0.2 | 1.3 | 29.6 | 0.4 | 0.1 | 0.9 | 0.1 | 3.6 | 31.4 | 0.0 |
| | 46 | 32.9 | 0.2 | 0.4 | 1.4 | 25.4 | 0.5 | 0.1 | 0.7 | 0.0 | 3.5 | 34.8 | 0.0 |
| | 47 | 38.3 | 0.2 | 0.4 | 1.3 | 19.9 | 0.1 | 0.1 | 0.5 | 0.0 | 4.7 | 34.6 | 0.0 |
| | 48 | 30.8 | 0.5 | 0.4 | 1.3 | 28.2 | 0.6 | 0.5 | 1.0 | 0.1 | 4.4 | 32.2 | 0.1 |
| | 49 | 33.7 | 0.6 | 0.5 | 1.0 | 28.9 | 0.5 | 0.2 | 0.8 | 0.1 | 3.8 | 30.0 | 0.0 |
| | 50 | 22.6 | 0.4 | 0.3 | 1.0 | 39.8 | 0.4 | 0.0 | 0.8 | 0.1 | 6.1 | 28.5 | 0.1 |
| | Average | 31.3 | 0.4 | 0.4 | 1.2 | 29.7 | 0.3 | 0.2 | 0.8 | 0.0 | 4.4 | 31.3 | 0.0 |

TABLE 9

| | Measurement point | Content of each element in grain boundary triple point (each measurement point) (atom %) | | | | | | | | | | | |
|---|---|---|---|---|---|---|---|---|---|---|---|---|---|
| | | Nd | Pr | Dy | Tb | Fe | Co | Cu | Al | Ga | O | C | N |
| Sample No. 6 | 51 | 25.3 | 7.8 | 0.8 | 1.7 | 21.6 | 0.5 | 0.0 | 0.3 | 0.3 | 15.8 | 25.3 | 0.7 |
| | 52 | 15.0 | 4.6 | 0.4 | 1.0 | 53.4 | 0.4 | 1.3 | 2.1 | 0.2 | 4.9 | 16.2 | 0.6 |
| | 53 | 21.0 | 6.5 | 0.9 | 1.7 | 27.0 | 0.4 | 2.3 | 1.6 | 0.0 | 5.8 | 32.8 | 0.0 |
| | 54 | 18.2 | 5.6 | 0.6 | 1.4 | 47.8 | 0.4 | 0.2 | 0.9 | 0.0 | 7.4 | 17.5 | 0.0 |
| | 55 | 14.2 | 4.4 | 0.8 | 1.1 | 43.6 | 0.3 | 2.5 | 1.2 | 0.0 | 4.4 | 27.5 | 0.0 |
| | 56 | 27.8 | 8.5 | 2.6 | 0.9 | 11.1 | 0.4 | 3.4 | 0.7 | 0.2 | 14.0 | 27.7 | 2.8 |
| | 57 | 15.2 | 4.7 | 1.0 | 1.9 | 44.0 | 0.5 | 2.2 | 3.3 | 0.1 | 5.6 | 20.2 | 1.3 |
| | 58 | 15.4 | 4.7 | 1.0 | 1.2 | 42.7 | 0.4 | 1.3 | 3.3 | 0.1 | 9.4 | 20.6 | 0.0 |
| | 59 | 15.2 | 4.7 | 0.5 | 1.1 | 38.0 | 0.3 | 0.2 | 0.7 | 0.4 | 6.5 | 32.5 | 0.0 |
| | 60 | 20.1 | 6.2 | 1.3 | 1.0 | 22.3 | 0.2 | 0.7 | 0.9 | 0.1 | 14.5 | 32.7 | 0.0 |
| | Average | 18.7 | 5.8 | 1.0 | 1.3 | 35.1 | 0.4 | 1.4 | 1.5 | 0.1 | 8.8 | 25.3 | 0.5 |

TABLE 10

| | | Average of content of each element in grain boundary triple point (atom %) | | | | | | | | | | | | ([Fe] + [Co])/ | [Cu]/ |
|---|---|---|---|---|---|---|---|---|---|---|---|---|---|---|---|
| | | [Nd] | [Pr] | [Dy] | [Tb] | [Fe] | [CO] | [CU] | [Al] | [GA] | [O] | [C] | [N] | ([Nd] + [Pr]) | ([Dy] + [Tb]) |
| Sample No. 1 | Example | 16.9 | 5.8 | 0.0 | 1.8 | 46.9 | 1.9 | 3.7 | 0.7 | 0.1 | 4.9 | 16.2 | 1.2 | 2.15 | 2.06 |
| Sample No. 2 | Example | 16.1 | 0.3 | 0.4 | 0.4 | 64.7 | 0.4 | 1.1 | 0.7 | 0.0 | 3.2 | 12.2 | 0.4 | 3.97 | 1.38 |
| Sample No. 3 | Example | 15.4 | 4.7 | 1.4 | 1.1 | 42.1 | 0.5 | 3.0 | 1.1 | 0.1 | 5.1 | 25.1 | 0.4 | 2.12 | 1.20 |
| Sample No. 4 | Example | 15.2 | 5.0 | 0.0 | 1.7 | 39.6 | 1.5 | 3.5 | 0.5 | 0.1 | 15.3 | 16.3 | 1.3 | 2.03 | 2.06 |
| Sample No. 5 | Comparative Example | 31.3 | 0.4 | 0.4 | 1.2 | 29.7 | 0.3 | 0.2 | 0.8 | 0.0 | 4.4 | 31.3 | 0.0 | 0.95 | 0.13 |
| Sample No. 6 | Comparative Example | 18.7 | 5.8 | 1.0 | 1.3 | 35.1 | 0.4 | 1.4 | 1.5 | 0.1 | 8.8 | 25.3 | 0.5 | 1.45 | 0.61 |

INDUSTRIAL APPLICABILITY

A permanent magnet of the present invention is excellent in magnetic properties, applicable to, for example, a motor or a generator of hybrid vehicles or electric vehicles.

REFERENCE SIGN LIST

2: PERMANENT MAGNET, 2*cs*: CROSS SECTION OF PERMANENT MAGNET, 4: MAIN PHASE GRAIN, 6: GRAIN BOUNDARY TRIPLE POINT, 10: TWO-GRAIN BOUNDARY

What is claimed is:

1. An R-T-B permanent magnet comprising rare-earth elements R, transition metal elements T, and boron B;

wherein at least some of the rare-earth elements R are neodymium and at least one of terbium and dysprosium;

at least some of the transition metal elements T are iron;

the R-T-B permanent magnet comprises a plurality of main phase grains and grain boundary triple points each surrounded by three or more main phase grains adjacent to each of the grain boundary triple points;

the grain boundary triple points comprise copper, at least one of neodymium and praseodymium, at least one of terbium and dysprosium, and at least one of iron and cobalt;

the average content of neodymium in ten grain boundary triple points is represented by [Nd] atom %;

the average content of praseodymium in the ten grain boundary triple points is represented by [Pr] atom %;

the average content of terbium in the ten grain boundary triple points is represented by [Tb] atom %;

the average content of dysprosium in the ten grain boundary triple points is represented by [Dy] atom %;

the average content of iron in the ten grain boundary triple points is represented by [Fe] atom %;

the average content of cobalt in the ten grain boundary triple points is represented by [Co] atom %;

the average content of copper in the ten grain boundary triple points is represented by [Cu] atom %;

the ten grain boundary triple points are in a cross-section of the R-T-B permanent magnet photographed by a scanning electron microscope;

[Nd], [Pr], [Tb], [Dy], [Fe], [Co], and [Cu] are measured by an energy dispersive X-ray spectrometer;

[Nd], [Pr], [Fe] and [Co] satisfy $2.00 \leq ([Fe]+[Co])/([Nd]+[Pr]) \leq 5.00$; and

[Tb], [Dy] and [Cu] satisfy $1.00 \leq [Cu]/([Tb]+[Dy]) \leq 4.00$.

2. The R-T-B permanent magnet according to claim 1, wherein the total content of terbium and dysprosium in the whole of the R-T-B permanent magnet is 0.20% by mass or more and 5.00% by mass or less.

3. The R-T-B permanent magnet according to claim 1, wherein the total content of neodymium, praseodymium, terbium and dysprosium in the whole of the R-T-B permanent magnet is 27.00% by mass or more and 33.00% by mass or less;

the copper content in the whole of the R-T-B permanent magnet is 0.04% by mass or more and 0.50% by mass or less;

the gallium content in the whole of the R-T-B permanent magnet is 0.03% by mass or more and 0.30% by mass or less;

the cobalt content in the whole of the R-T-B permanent magnet is 0.30% by mass or more and 3.00% by mass or less;

the aluminum content in the whole of the R-T-B permanent magnet is 0.15% by mass or more and 0.30% by mass or less;

the zirconium content in the whole of the R-T-B permanent magnet is 0.10% by mass or more and 1.00% by mass or less;

the manganese content in the whole of the R-T-B permanent magnet is 0.02% by mass or more and 0.10% by mass or less; and the boron content in the whole of the R-T-B permanent magnet is 0.85% by mass or more and 1.05% by mass or less.

* * * * *